US005797471A

United States Patent [19]

Princell

[11] Patent Number: 5,797,471

[45] Date of Patent: Aug. 25, 1998

[54] LINEAR DOOR DRIVE OPERATOR

[75] Inventor: John Princell, Moline, Ill.

[73] Assignee: Montgomery Kone Inc., Moline, Ill.

[21] Appl. No.: 684,153

[22] Filed: Jul. 19, 1996

[51] Int. Cl.[6] ..... B66B 13/06

[52] U.S. Cl. ..... 187/324; 187/325; 187/318; 187/319

[58] Field of Search ..... 187/318, 319, 187/324, 325

[56] References Cited

U.S. PATENT DOCUMENTS

| | | | |
|---|---|---|---|
| 505,270 | 9/1893 | Hicks et al. | 187/324 |
| 1,707,648 | 4/1929 | Turner et al. | 187/324 |
| 2,121,906 | 6/1938 | Dunn | 187/324 |
| 2,899,021 | 8/1959 | O'Grady | 187/319 |
| 2,905,463 | 9/1959 | Borden | 187/324 |
| 4,177,881 | 12/1979 | Kappenhagen | 187/324 |
| 4,685,537 | 8/1987 | Kappenhagen | 187/324 |

*Primary Examiner*—Joseph E. Valenza
*Assistant Examiner*—Mark Deuble
*Attorney, Agent, or Firm*—Wood, Phillips, VanSanten, Clark & Mortimer

[57] ABSTRACT

An elevator system has a car provided with a doorway and a door movable across the doorway. An improved mechanism to move the door selectively to open and closed positions includes a header mounted to the car above the door. The header supports a linear drive carrying the door. The drive includes a spool rotationally mounted to the header for driving a cable wound about the spool, the cable being operatively connected to a hanger carrying the door for moving the hanger linearly across the header responsive to rotational movement of the spool. The spool further includes a vertically extending axial opening. A door operator comprises a motor driving an output shaft. The door operator is secured to the header so that the output shaft is received in the spool axial opening, whereby operation of the motor causes rotation of the spool.

20 Claims, 22 Drawing Sheets

LINEAR DOOR DRIVE OPERATOR

FIELD OF THE INVENTION

The present invention relates to elevator systems and, more particularly, to an improved linear door drive operator for opening and closing an elevator door.

BACKGROUND OF THE INVENTION

A typical elevator system, such as a passenger elevator, has a car movable in a hoistway between landings at each floor. The car is provided with a doorway. Either a door or pair of doors are selectively movable across the doorway between open and close positions. Likewise, a door or pair of doors is provided at each landing. The landing doors are opened and closed in direct response to open and close movement of the car doors when at the particular landing.

Most commonly, elevator systems include door operators using belt drives for opening and closing the doors. The belt drive is driven by a motor. The drive and motor are mounted atop the car. Speed reduction is provided by the belt drive. An output pulley is rotated through 180° to open or close the door and provide a sinusoidal form of motion. A bar is attached to the door and the pulley mechanism for actually controlling movement of the door.

Such a door operator, owing to the belt reduction mechanism, is large in size and weight and occupies space above the car. Significant time is required for installing and adjusting the operator when it is placed atop the car in the field. The installation and adjustment can be difficult owing to difficulties of access to the mechanical equipment while verifying proper operation. Likewise, electrical adjustments must be made by adjusting potentiometers or the like. This can be a time consuming process requiring trial and error to achieve proper operation.

The present invention is directed to overcoming one or more of the problems discussed above in a novel and simple manner.

SUMMARY OF THE INVENTION

In accordance with the invention there is provided an elevator system having a linear door drive operator for controlling opening and closing movement of an elevator door.

Broadly, there is disclosed herein an elevator system having a car provided with a doorway and a door movable across the doorway. An improved mechanism to move the door selectively to open and closed positions includes a header mounted to the car above the door. The header supports a linear drive carrying the door. The drive includes a spool means rotationally mounted to the header for driving a cable wound about the spool means, the cable being operatively connected to a hanger carrying the door for moving the hanger linearly across the header responsive to rotational movement of the spool means. The spool means further includes a vertically extending axial opening. A door operator comprises a motor driving an output shaft. Means are provided for securing the door operator to the header so that the output shaft is received in the spool means axial opening, whereby operation of the motor causes rotation of the spool means.

In accordance with one aspect of the invention, the output shaft comprises a Morse taper shaft.

In accordance with another aspect of the invention, the motor has a motor shaft and the operator further comprises a worm gear having an input shaft and the output shaft is part of the worm gear. Means are provided for coupling the motor shaft to the input shaft. The operator further comprises a bracket supporting the motor and the worm gear, with the motor shaft extending horizontally and the output shaft extending vertically downwardly. The securing means comprises a fastener securing the bracket to the header and a nut threaded to the output shaft for securing the output shaft to the spool means. The motor is resiliently mounted to the bracket using rubber washers.

In accordance with a further aspect of the invention, the spool means comprises a spool having circumferential grooves carrying the cable. The spool is received between blocks mounting the spool to the header.

In accordance with a further aspect of the invention, an auto-tensioner is mounted to the header opposite the spool means for maintaining tension on the cable.

In accordance with yet another aspect of the invention, the car is provided with a pair of doors movable across the doorway and the cable is operatively connected to a pair of hangers carrying the respective doors.

In accordance with a further aspect of the invention, the door operator comprises a permanent magnet DC motor. An electrical control circuit includes a bridge circuit electrically connected to the motor. A programmed processing circuit operates the bridge circuit. The processing circuit operates in accordance with a stored program to control operation of the motor using stored user-selected variables defining movement parameters for door operation.

Further features and advantages of the invention will be readily apparent from the specification and from the drawing.

DETAILED DESCRIPTION OF THE INVENTION

Figure 1:
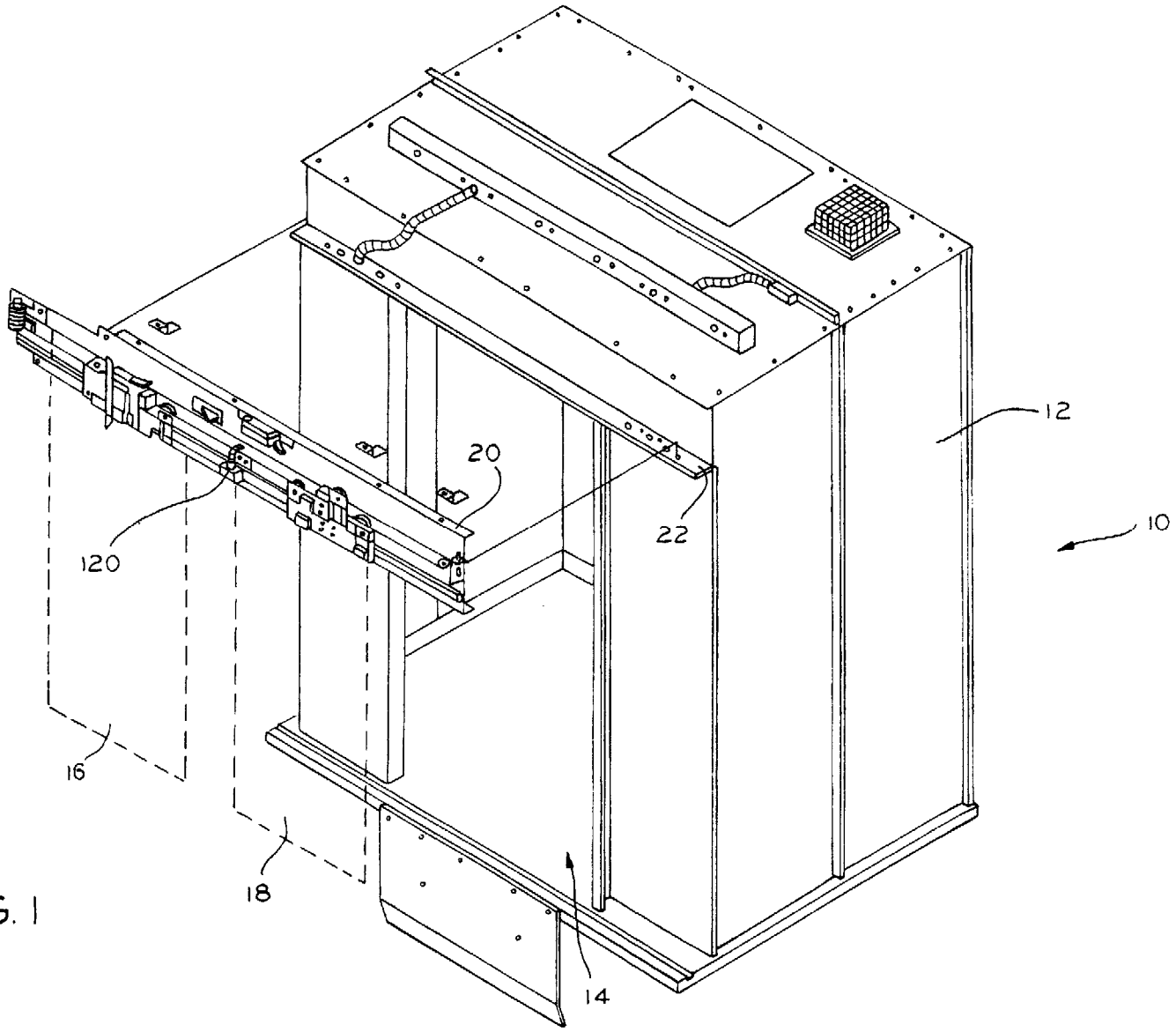
FIG. 1 is a partial exploded perspective view of an elevator system including a linear door drive according to the invention.

Referring initially to FIG. 1, there is illustrated an elevator system 10 having a car 12 with a doorway 14. A pair of doors 16 and 18 are movably mounted to the car 12 for providing selective access to the doorway 14. Although not illustrated, the car 12 is movable in a hoistway for carrying passengers or freight or the like between landings on different floors. The present invention is directed specifically to an improved mechanism to move the doors 16 and 18 to open and closed positions.

A header 20 is mounted to the car 12 above the doorway 14. Particularly, the header 20 rests upon a ledge 22 immediately above the doorway 14 and extending the width of the car 12. Suitable fasteners (not shown) are used for securing the header 20 to the car 12.

Figure 2:
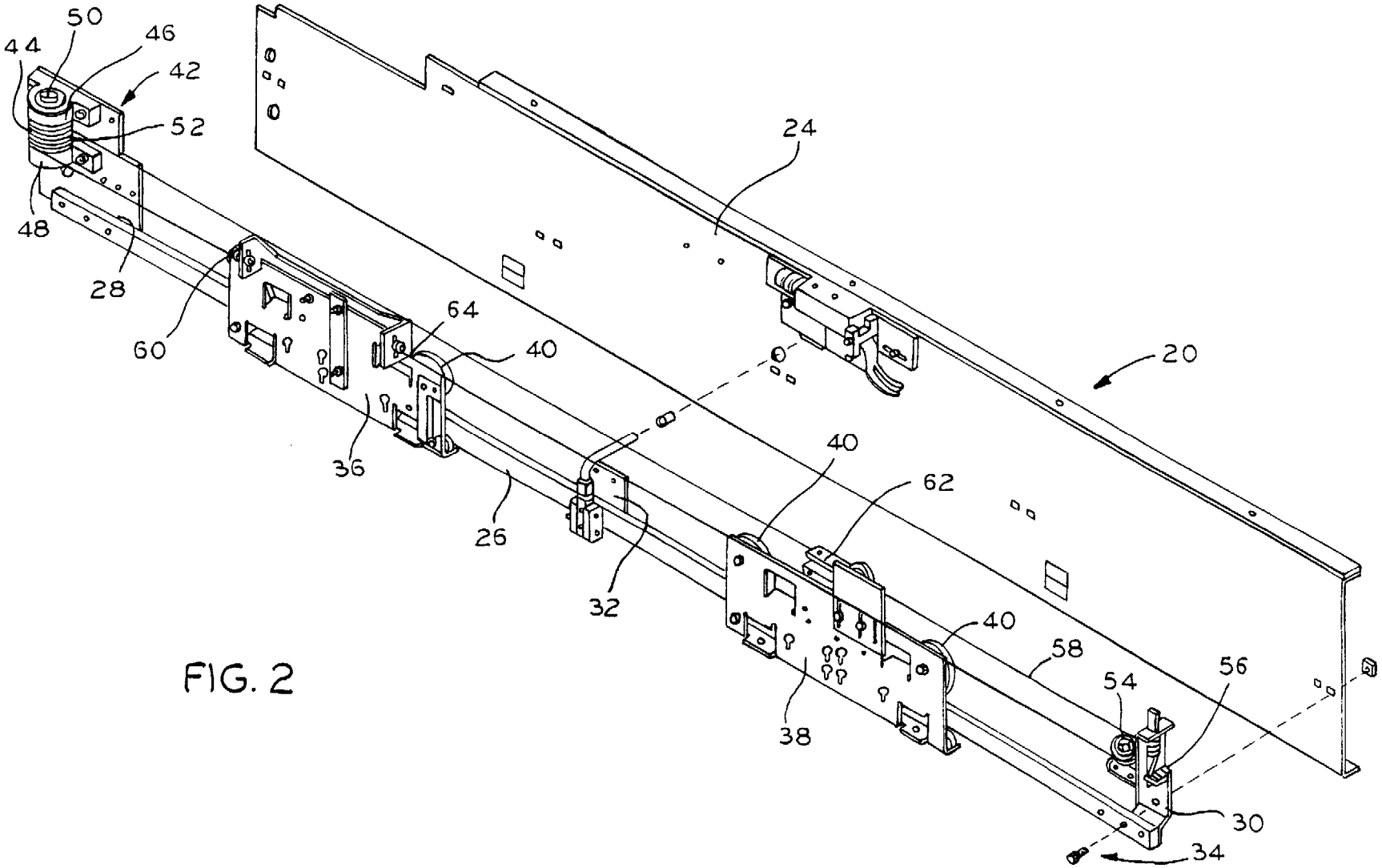
FIG. 2 is an exploded perspective view of the linear door drive of FIG. 1.

Referring to FIG. 2, the header 20 comprises a generally rectangular elongate plate 24. The plate 24 supports an elongate track 26 using five brackets, three of which are shown, including opposite first and second end brackets 28 and 30, respectively, and a central bracket 32. The brackets 28, 30 and 32 are secured to the plate 24 using suitable fasteners, one of which is illustrated at 34. First and second hangers 36 and 38 include wheels 40 for riding on the track 26. The header 20 further supports a linear door drive 42 for controlling movement of the hangers 36 and 38, as described below.

The linear door drive 42 comprises a wrap-around spool 44 rotationally mounted to the first end bracket 28 using a pair of pillow blocks 46 and 48. The spool 44 has a vertically extending axial opening 50 and includes a plurality of longitudinally spaced circumferential grooves 52.

A sheave 54 is mounted to the second end bracket 30 using an auto-tensioner 56. A cable 58 is connected at one end 60 to the first hanger 36. The cable 58 is then wound about the spool 44, being received in the grooves 52. The cable 58 then extends across the header 20, where it is attached to the second hanger 38 using fastening bracket 62. The cable 58 further extends around the sheave 54 and returns back where it is attached at a second end 64 to the first hanger 36. Owing to this construction, rotation of the spool 44 in a clockwise direction (looking downward) results in the hangers 36 and 38 moving apart. Conversely, when the spool 44 is rotated in the counter-clockwise direction, the hangers 36 and 38 are moved toward one another.

As generally illustrated in FIG. 1, the doors 16 and 18 are secured by suitable means to the respective hangers 36 and 38 in a conventional manner. Owing to the above-described construction, the spool 44 can be driven to move the hangers 36 and 38 together or apart to move the doors 16 and 18 to a respective close or open position.

Figure 3:
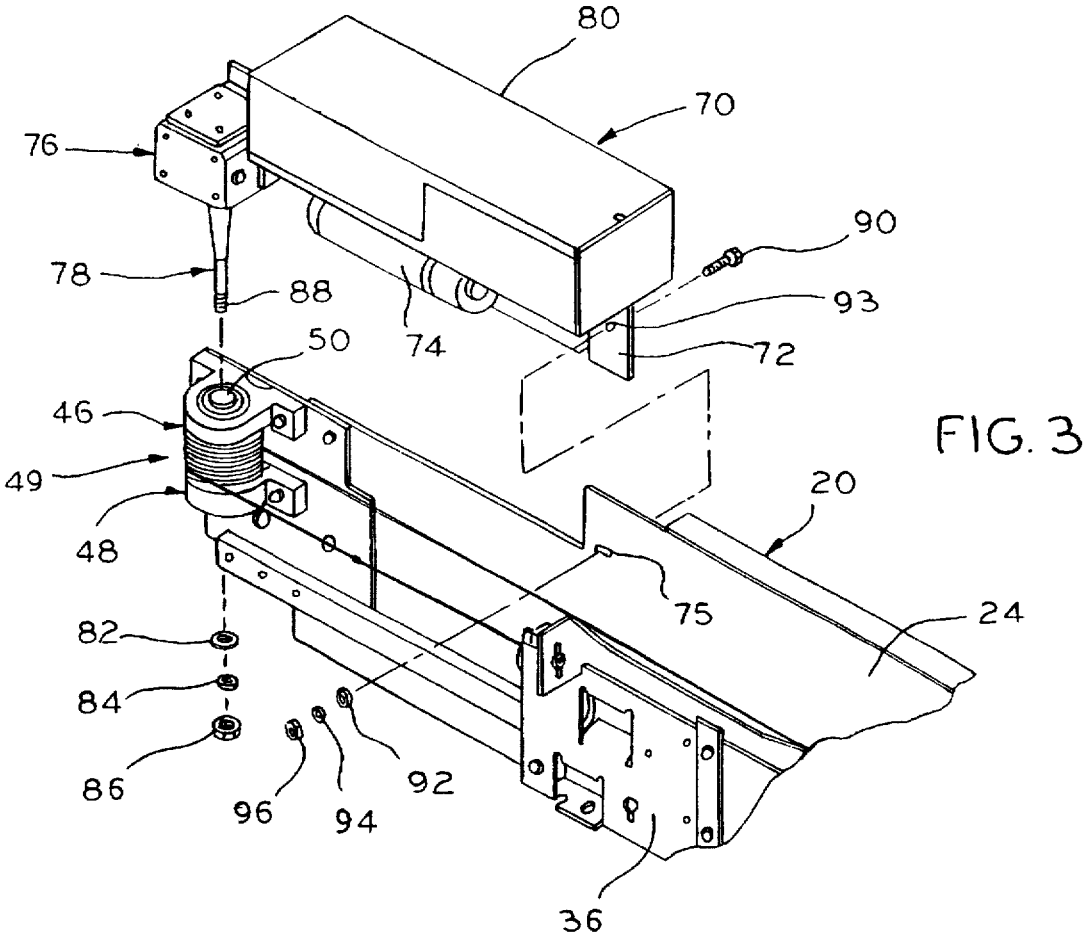
FIG. 3 is a partial exploded perspective view of the linear door drive of FIG. 1 illustrating installation of a door operator according to the invention.
Figure 4:
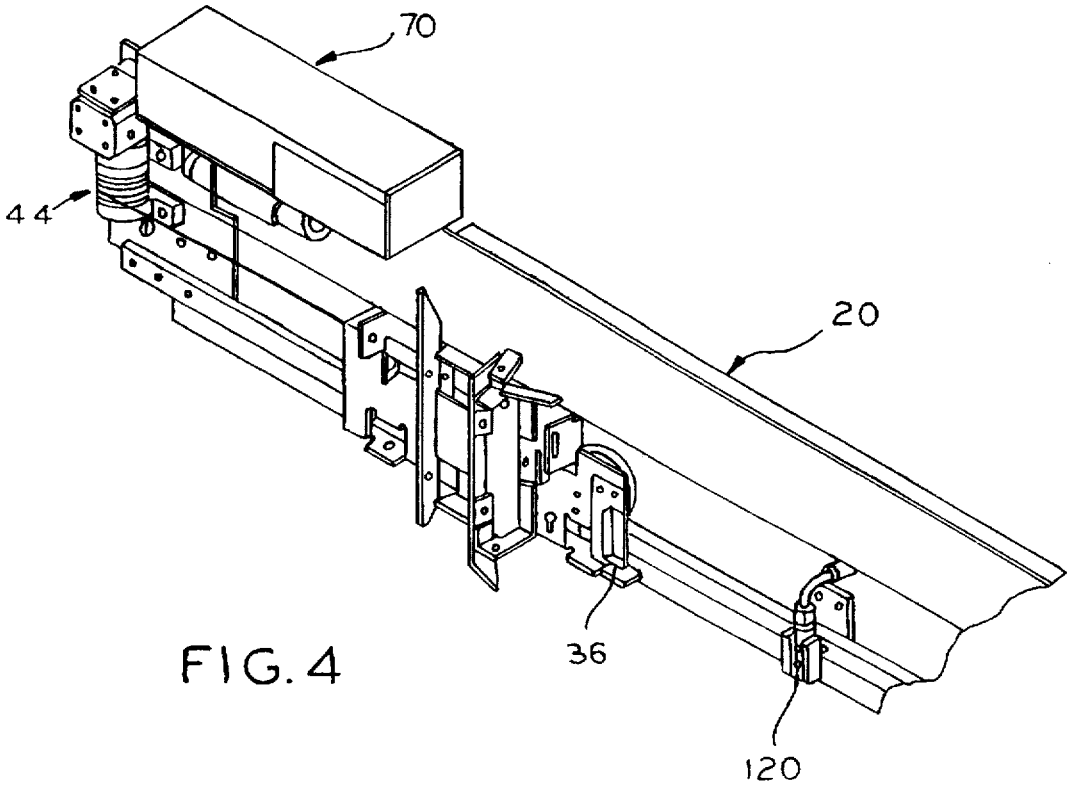
FIG. 4 is a partial perspective view similar to FIG. 3 showing the door operator secured to the door drive.

Referring to FIGS. 3 and 4, a linear door drive operator 70 is provided for driving the spool 44. The operator 70 includes a bracket 72 supporting a permanent magnet DC motor 74. The motor 74 in turn drives a worm gear box 76 having an output shaft 78. The output shaft 78 comprises a Morse taper shaft. A control housing 80 is mounted atop the bracket 72 above the motor 74.

To install the operator 70, a coating of anti-seize compound is applied to the output shaft 78. The shaft 78 is inserted into the spool opening 50. A washer 82, lock washer 84 and nut 86 are installed onto a threaded end 88 of the output shaft 78 to secure the output shaft 78 to the spool 44. The opposite end of the operator 70 is secured to the header 20 using a screw 90, washer 92, lock washer 94 and nut 96, extending through openings 93 and 95 in the bracket 72 and header plate 24, respectively, as illustrated. The resulting installation is particularly illustrated in FIG. 4.

Figure 5:
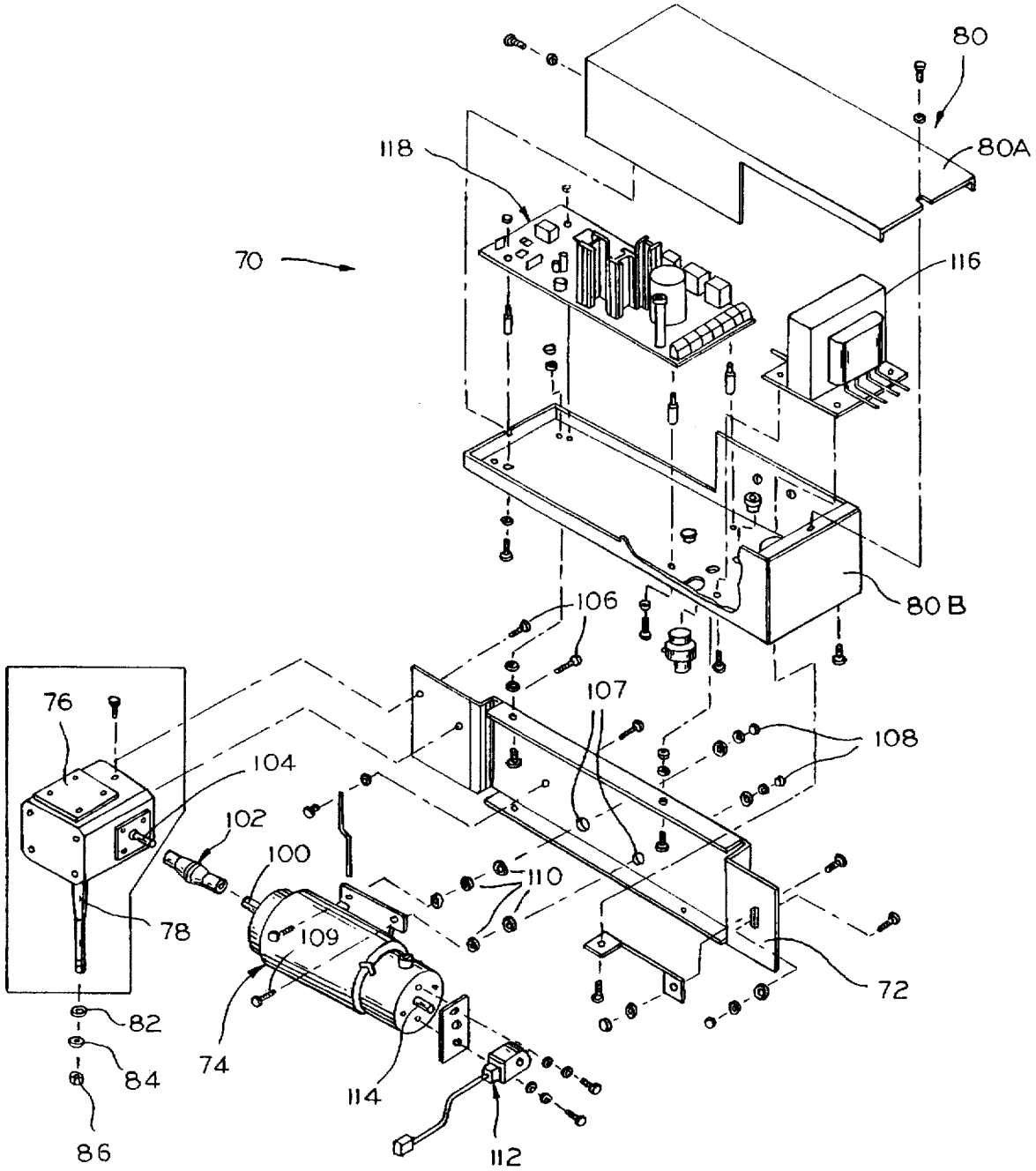
FIG. 5 is an exploded view of the door operator.

Referring to FIG. 5, the door operator 70 is illustrated in greater detail. The motor 74 includes a motor shaft 100. The motor shaft 100 is connected using a shaft coupling 102 to an input shaft 104 of the worm gear box 76. The worm gear box 76 is conventional in construction and acts as a gear reducer while providing mechanical advantage to operation of the spool 44. Further, by using a worm gear as shown, a lower profile linear door operator results which can be positioned generally forwardly of the car 12, rather than sitting atop the car 12 as with prior door operators.

The worm gear box 76 is mounted to the bracket 72 using suitable fasteners 106. The motor 74 is mounted to the bracket 72 using suitable fasteners 109 which extend through openings 107 in the bracket 72 and are secured by nuts 108. Four rubbers washers 110 are disposed between the motor 74 and the bracket 72 to mechanically isolate the motor 74 from the bracket 72 to reduce noise. Further, the shaft coupling 102 is a flex coupling which further minimizes noise from motor operation.

A rotary encoder 112 is mounted to an opposite end 114 of the motor shaft 100. The encoder 112 is used for sensing rotational movement of the shaft 100.

The enclosure 80 comprises a base 80B and top 80T. The enclosure 80 houses a transformer 116 and an electrical circuit board 118.

Also provided for sensing door position is a door close limit switch 120, see FIGS. 1 and 4. This limit switch 120 is actuated when the two doors 16 and 18 are in the close position, as is apparent.

Figure 6:
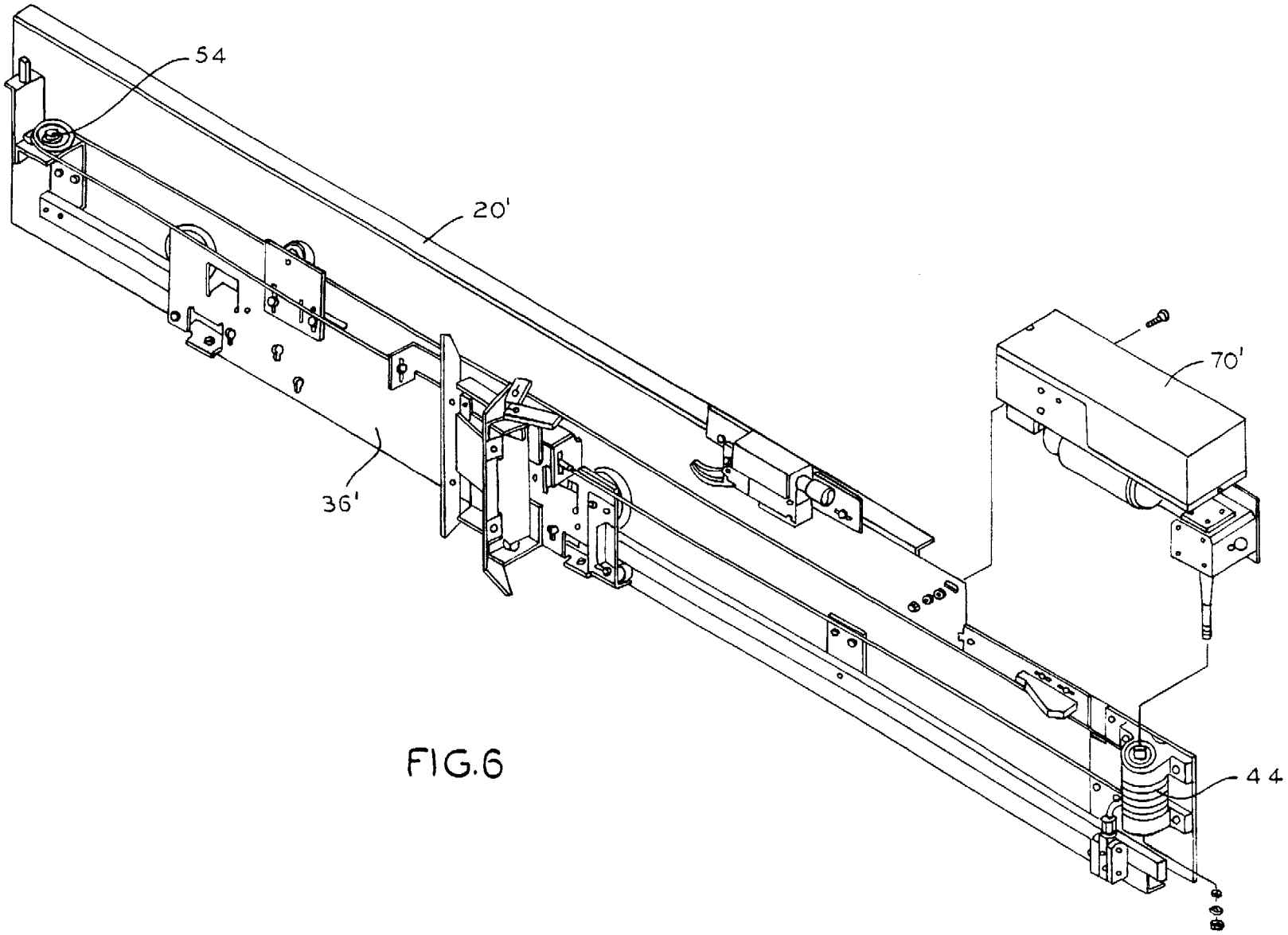
FIG. 6 is an exploded partial perspective view similar to FIG. 6 for an alternative embodiment of a linear door drive for a single door elevator system.

Referring to FIG. 6, there is illustrated a door mechanism for an alternative elevator construction including a single door. This construction differs in providing the spool 44 and sheave 54 at opposite ends of a header 20' and including only a single hanger 36'. A door operator 70' is virtually identical to the door operator 70 discussed above, albeit a mirror image for use at the opposite end. Likewise, the header 20' is a mirror image of the header 20 discussed above.

Thus, in accordance with the invention, the motor 74 is operated to drive the spool 44 through the worm gear 76 and particularly the output shaft 78. Actual control of the motor 74 is effected via the circuit on the circuit board 118.

Figure 7:
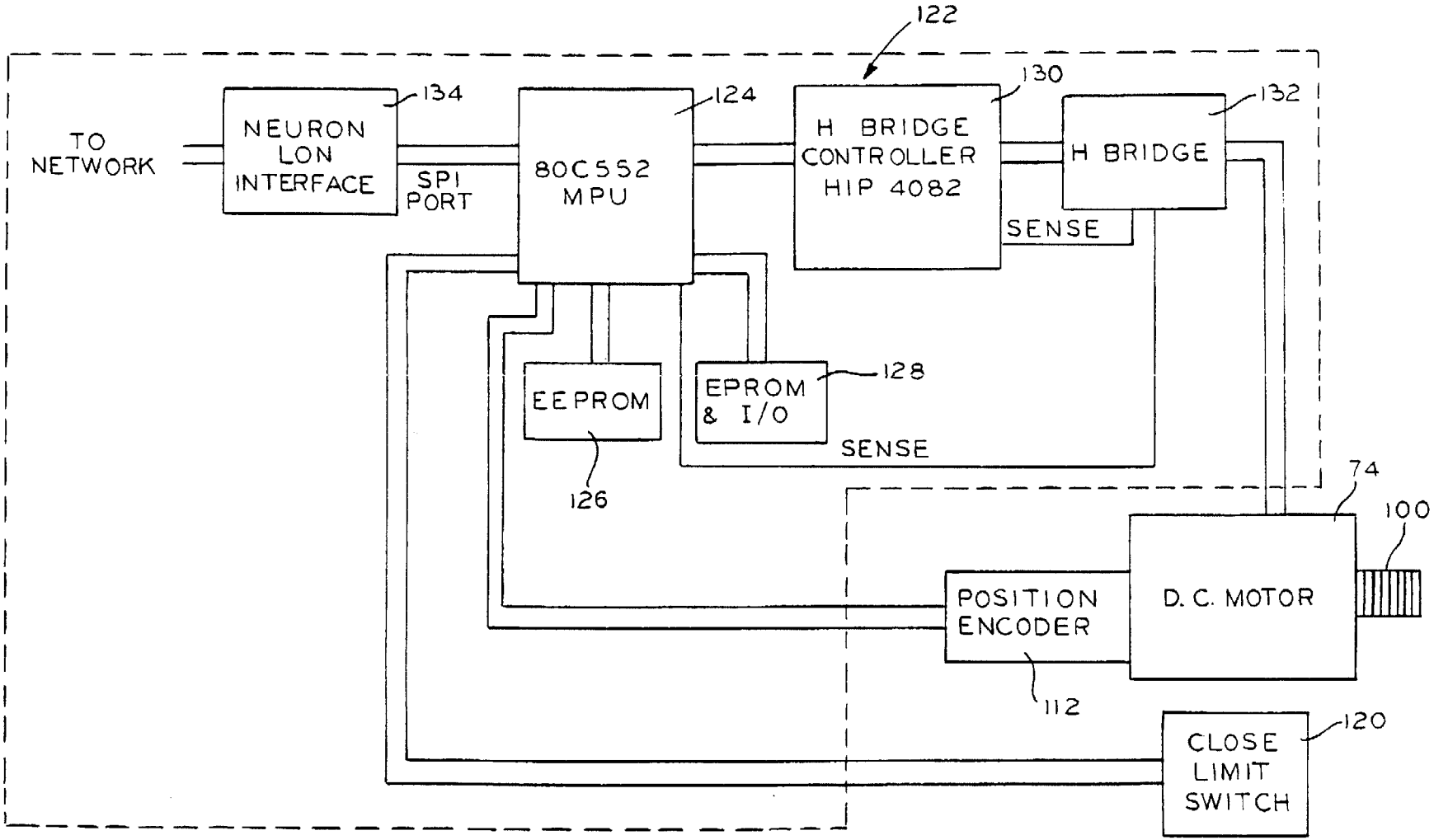
FIG. 7 is a block diagram of an electrical control circuit for the door operator.

Referring to FIG. 7, a block diagram illustrates an electrical circuit 122 for the operator 70. Those elements included on the circuit board 118 are included within the dashed lines.

The control circuit 122 includes a programmed processing circuit in the form of a microprocessor 124. In the illustrated embodiment of the invention, the microprocessor 124 comprises a type 80C552 microprocessor. The microprocessor 124 is connected to EEPROM memory 126 and to onboard EPROM and I/O circuits 128, as is conventional. The microprocessor 124 operates in accordance with a stored program, described below, to control operation of the motor 74 using stored user selected variables defining movement parameters for door operation.

The microprocessor 124 is connected via an H-bridge controller circuit 130 to an H-bridge circuit 132. The H-bridge circuit 132 is conventional in operation for controlling polarity of power provided to the DC motor 74. Providing power at one polarity causes the motor shaft 100 to rotate in one direction, while power at the opposite polarity causes the motor shaft 100 to rotate in the other direction, as is well known. Feedback information is provided from the H-bridge circuit 132 to both the H-bridge controller 130 and the microprocessor 124. The position encoder 112 and the close limit switch 120 are also connected to the microprocessor 124 for providing positional information. Particularly, the position encoder 112 is used for providing feedback representing incremental position used in determining absolute position. The close limit switch 120 is used for zeroing the actual position when the doors are closed.

The control circuit 122 is configured to operate within a network for communicating with other devices in the elevator system, such as the car control and the like. The connections are provided via a conventional Neuron® LON interface circuit 134 (Neuron is a registered trademark of Echelon Corporation). In addition to connecting to other control devices, the interface circuit 134 provides communication via a network to a programming device used for configuring operation of the control circuit 122 for making appropriate adjustments, as described below.

Figure 8:
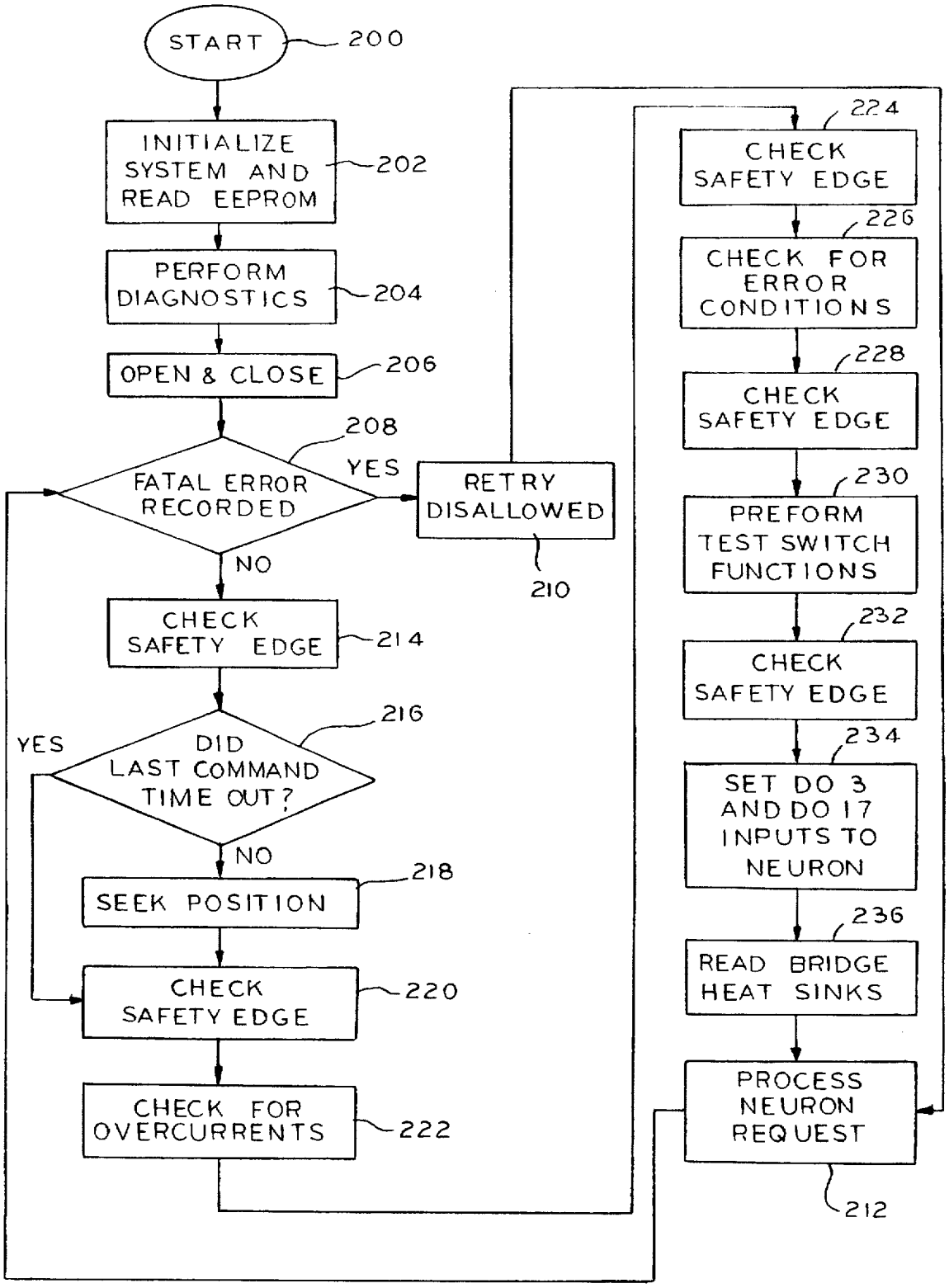
FIG. 8 comprises a flow diagram for a door controller main loop implemented in the microprocessor of FIG. 7.

Referring to FIG. 8, a flow diagram illustrates a main loop for the program implemented in the microprocessor 124 of FIG. 7 for controlling movement of the doors.

The main loop begins at a start node 200 and proceeds to a block 202, where the system is initialized and contents from the EEPROM 126 are read. Basic diagnostics are performed at a block 204. At a block 206 the control awaits an open or close command from the elevator system control. Upon receiving one of these commands the doors 16 and 18 are opened or closed at nudging speed until the closed limit switch 120 is activated. All door movement thereafter is at normal speed. Thereafter, these blocks are not used and a continuous loop is implemented.

The continuous loop begins at a block 208 which determines if a fatal error is recorded. If so, then a block 210 disallows further retries and the control proceeds to a Process Neuron Request routine at a block 212. Assuming no fatal error is recorded, then a Check Safety Edge routine is implemented at a block 214. The Check Safety Edge routine is implemented several times each cycle to provide speed of response. The safety edge is used for determining if there is an obstruction, such as a passenger, in the doorway 14.

A decision block 216 determines if the last command sent has timed out. This is done as commands are asynchronous in nature. If not, then a Seek Position routine is implemented at a block 218. Thereafter, or if the last command did time out, as determined at the decision block 216, then the Check Safety Edge routine is implemented at a block 220. A Check For Overcurrents routine is then implemented at a block 222. The Check Safety Edge routine is implemented at a block 224. A Check For Error Conditions routine is implemented at a block 226, followed again by a Check Safety Edge routine at a block 228. At a block 230 a Perform Test Switch Functions routine is implemented. This is done when an installer places the elevator system 10 in a test mode and the installer commands the elevator doors to stop, open, or close. The Check Safety Edge routine is then performed again at a block 232. D03 and D017 inputs on the microprocessor 124 are then set to interface with the Neuron® interface 134 at a block 234. At block 236 heat sinks from the H-bridge circuit 132 are read to ensure that there is no overheating condition. Finally, the Process Neuron Request routine is then implemented at the block 212. From the Process Neuron Request routine, the control loops back to the decision block 208 to repeat the loop.

As described the main loop is continually implemented to maintain the commanded position of the doors 16 and 18. The position command is received via the Neuron® interface 134 from a main elevator controller at a remote location.

Figure 9:
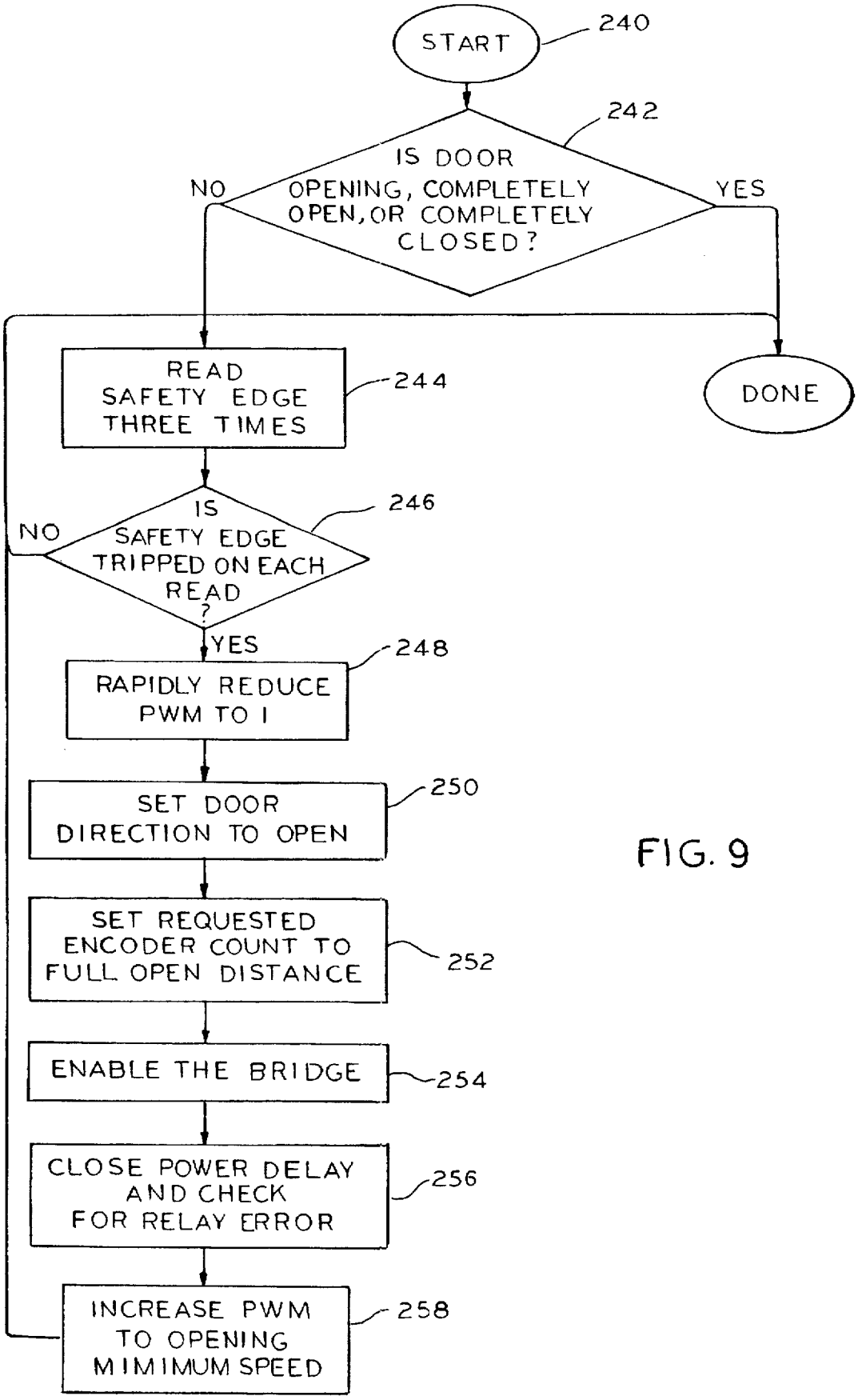
FIG. 9 comprise a flow diagram of a Check Safety Edge routine of the main loop of FIG. 8.
Figure 10A:
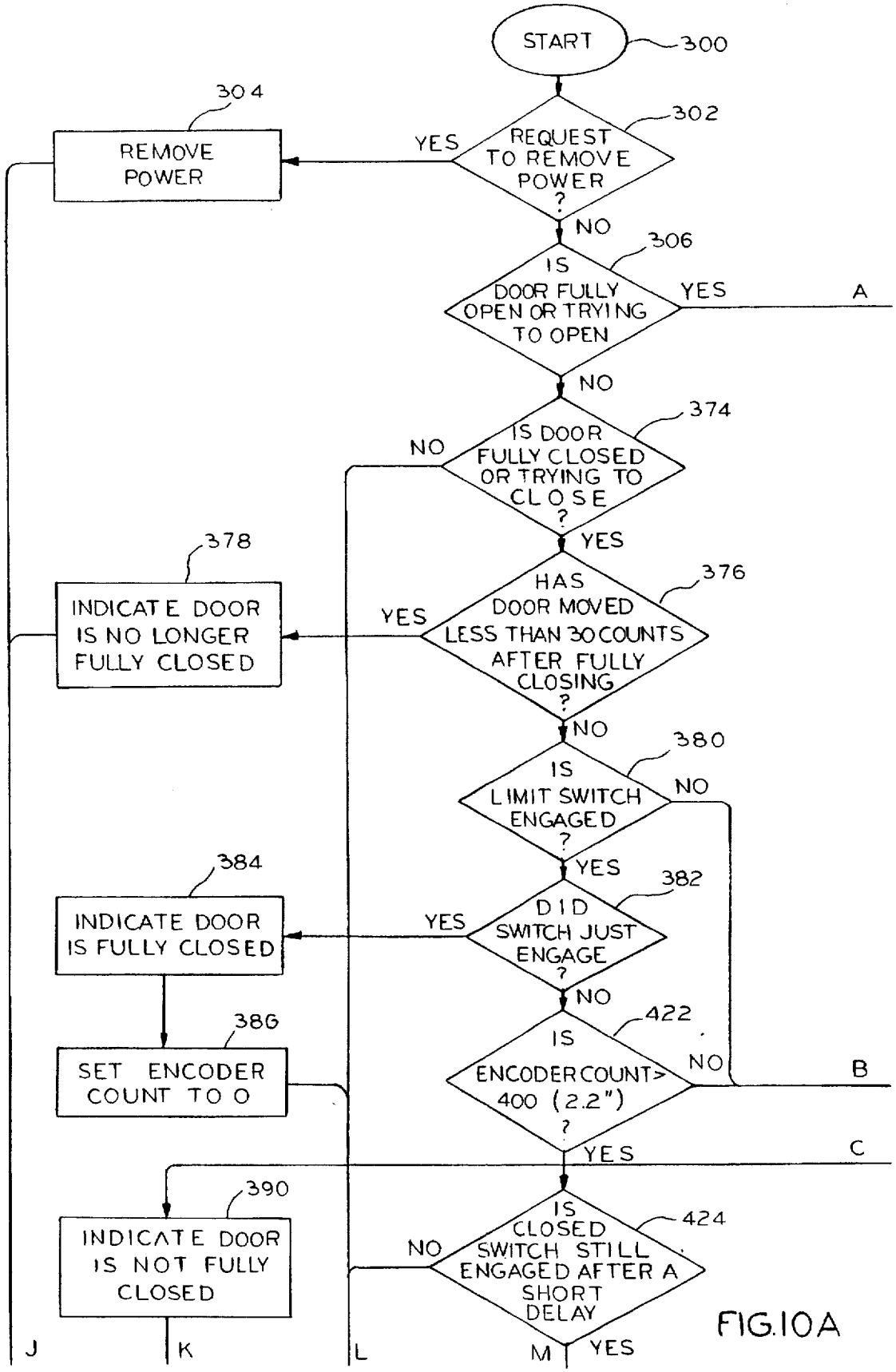
FIGS. 10A–10G comprise a flow diagram of a Seek Position routine of the main loop of FIG. 8.
Figure 10B:
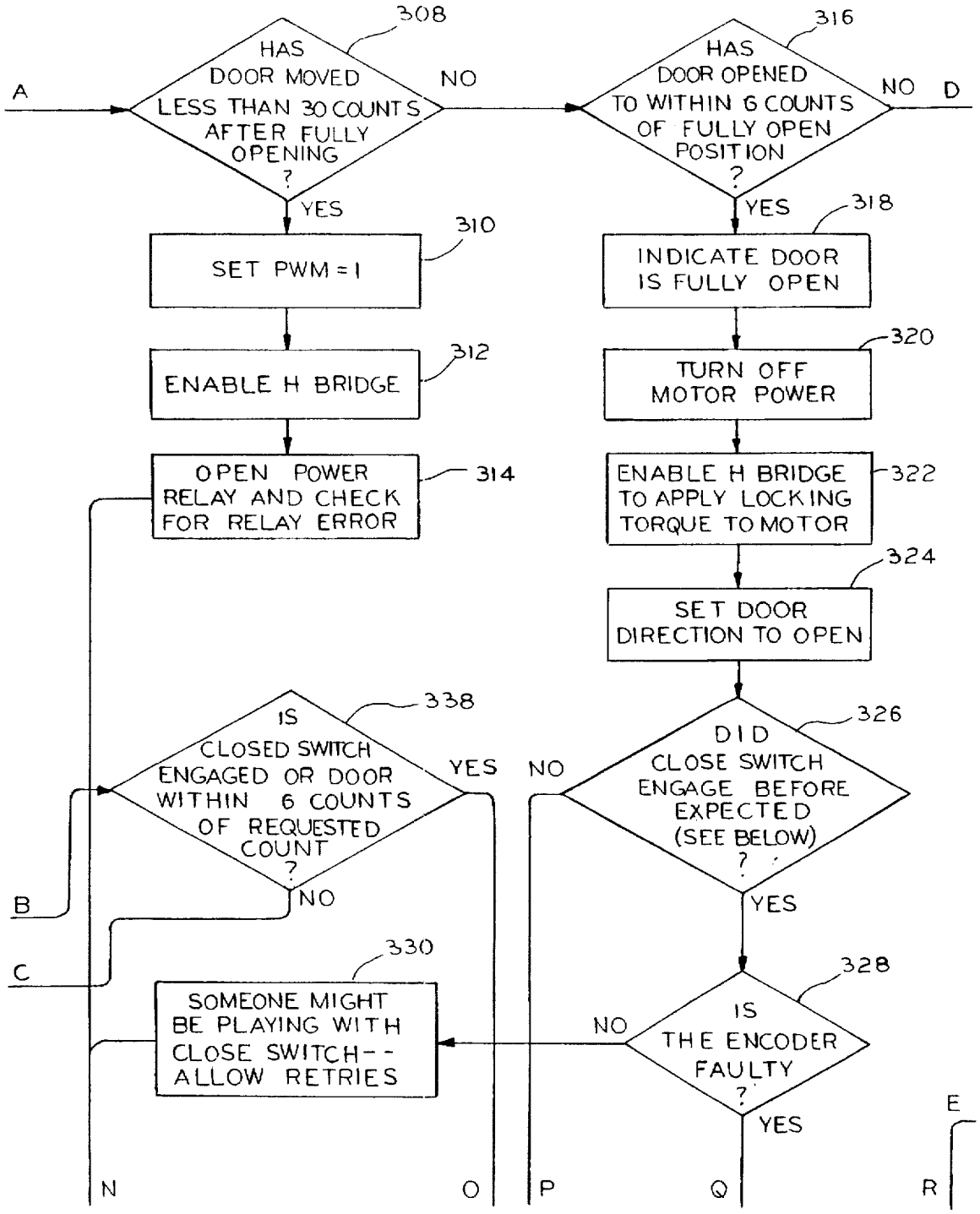
Figure 10C:
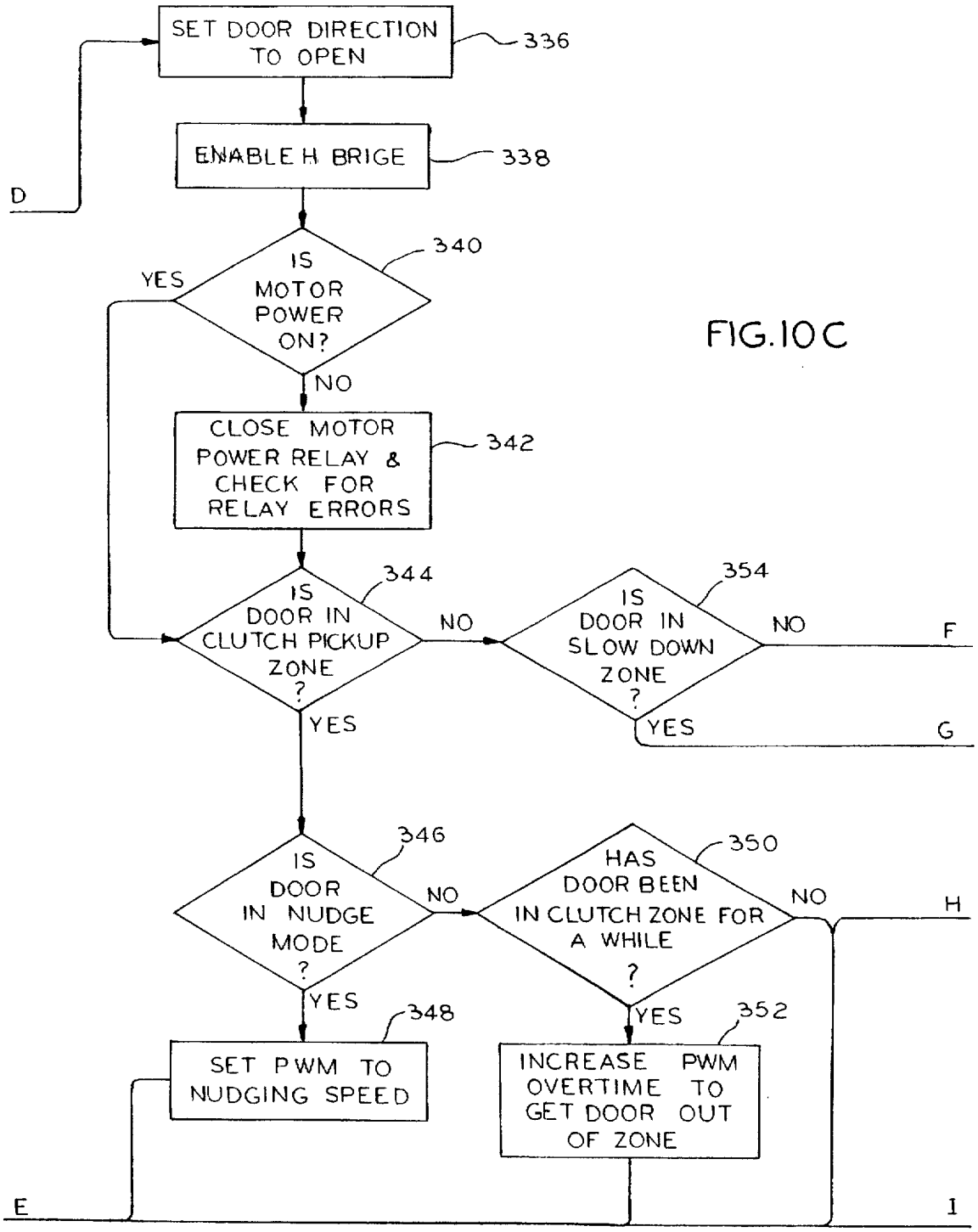
Figure 10D:
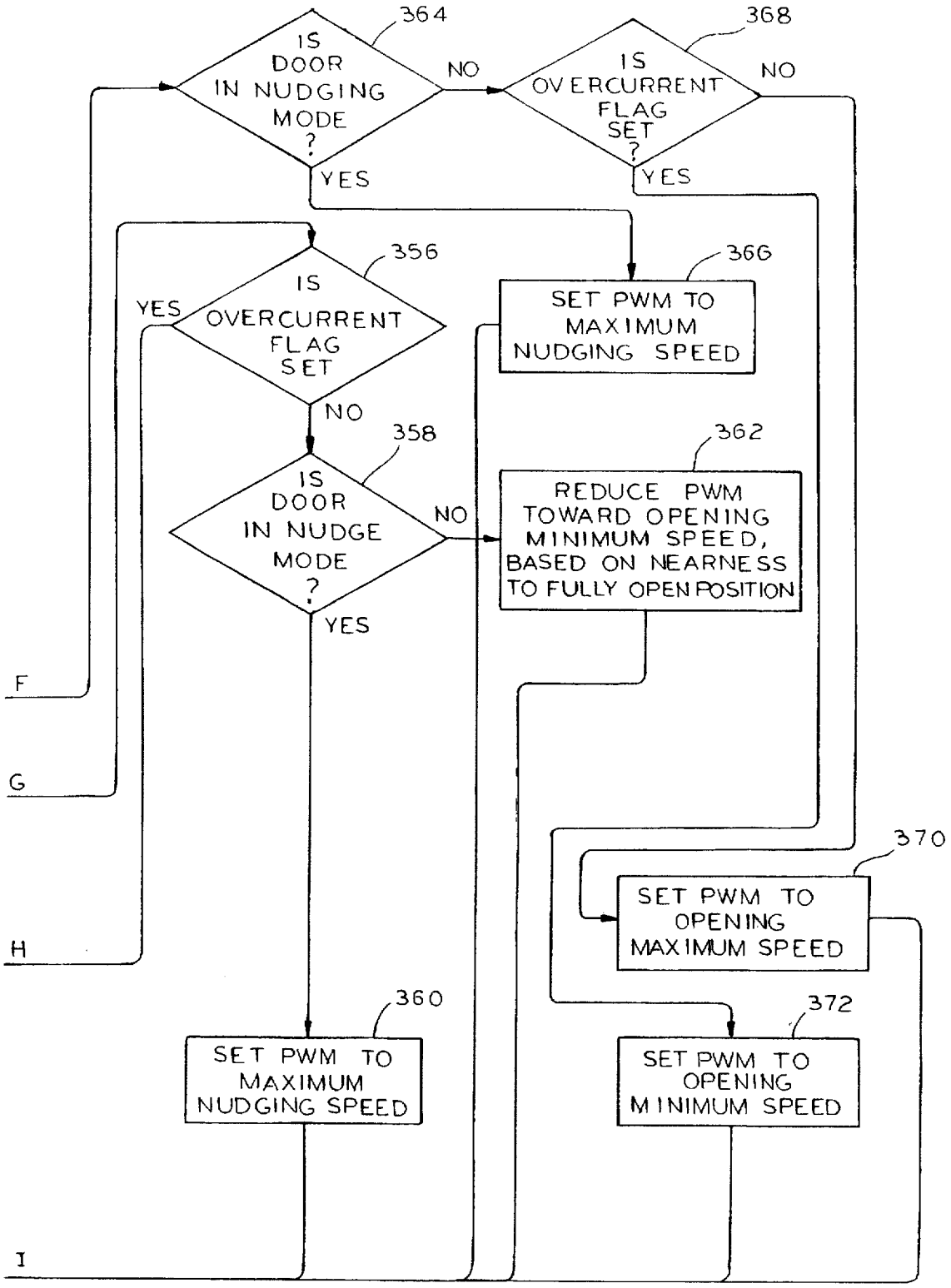
Figure 10E:
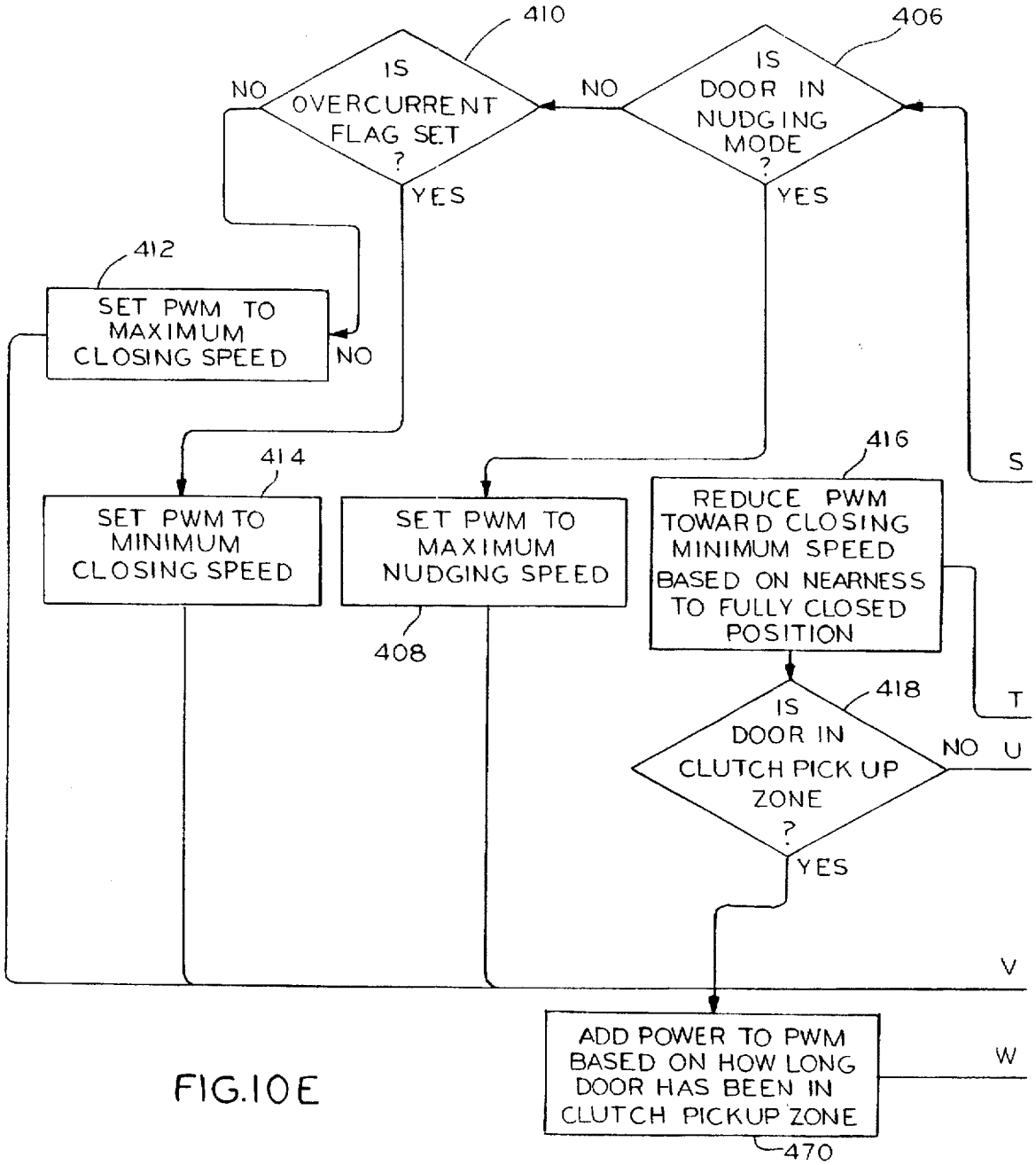
Figure 10F:
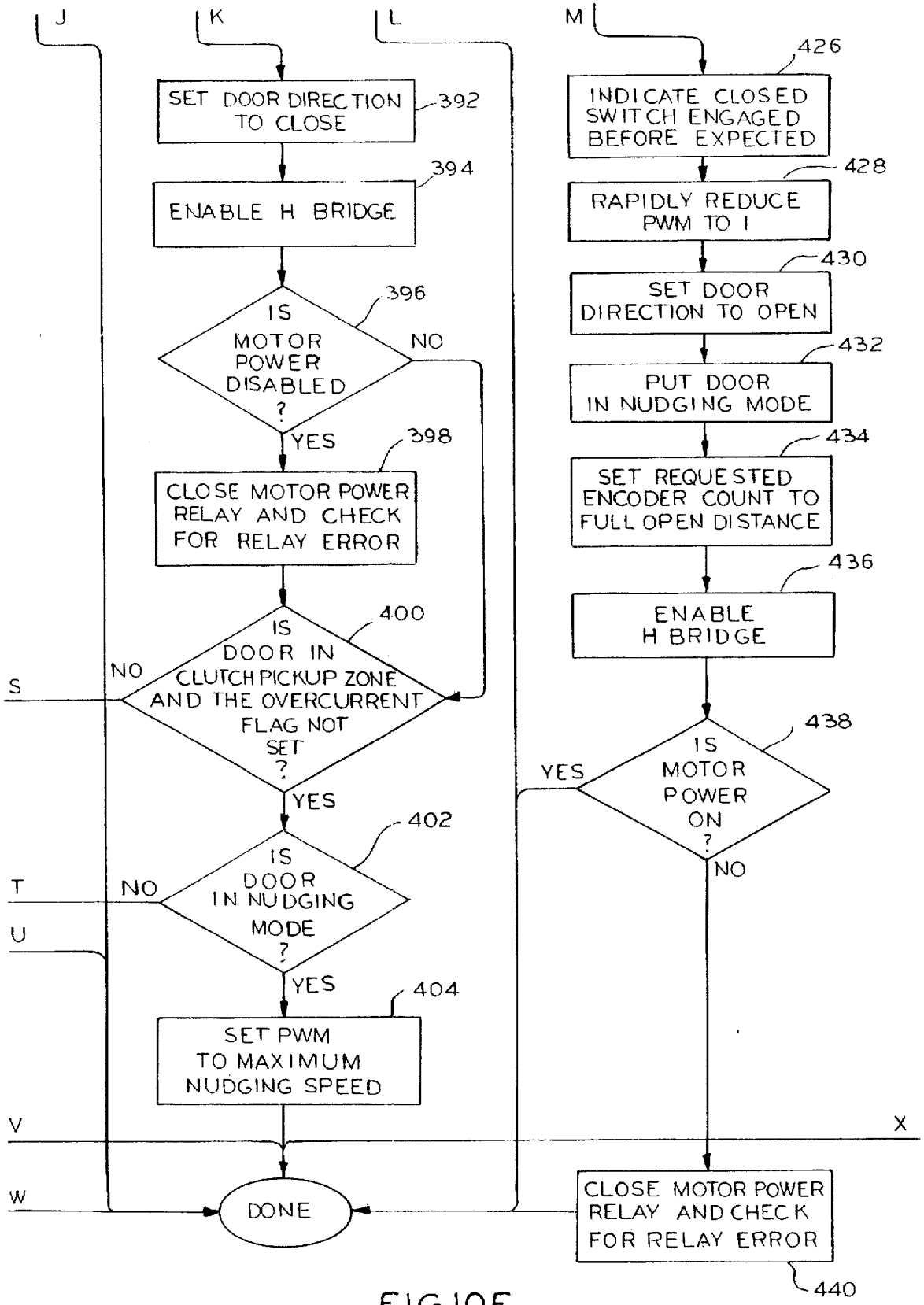
Figure 10G:
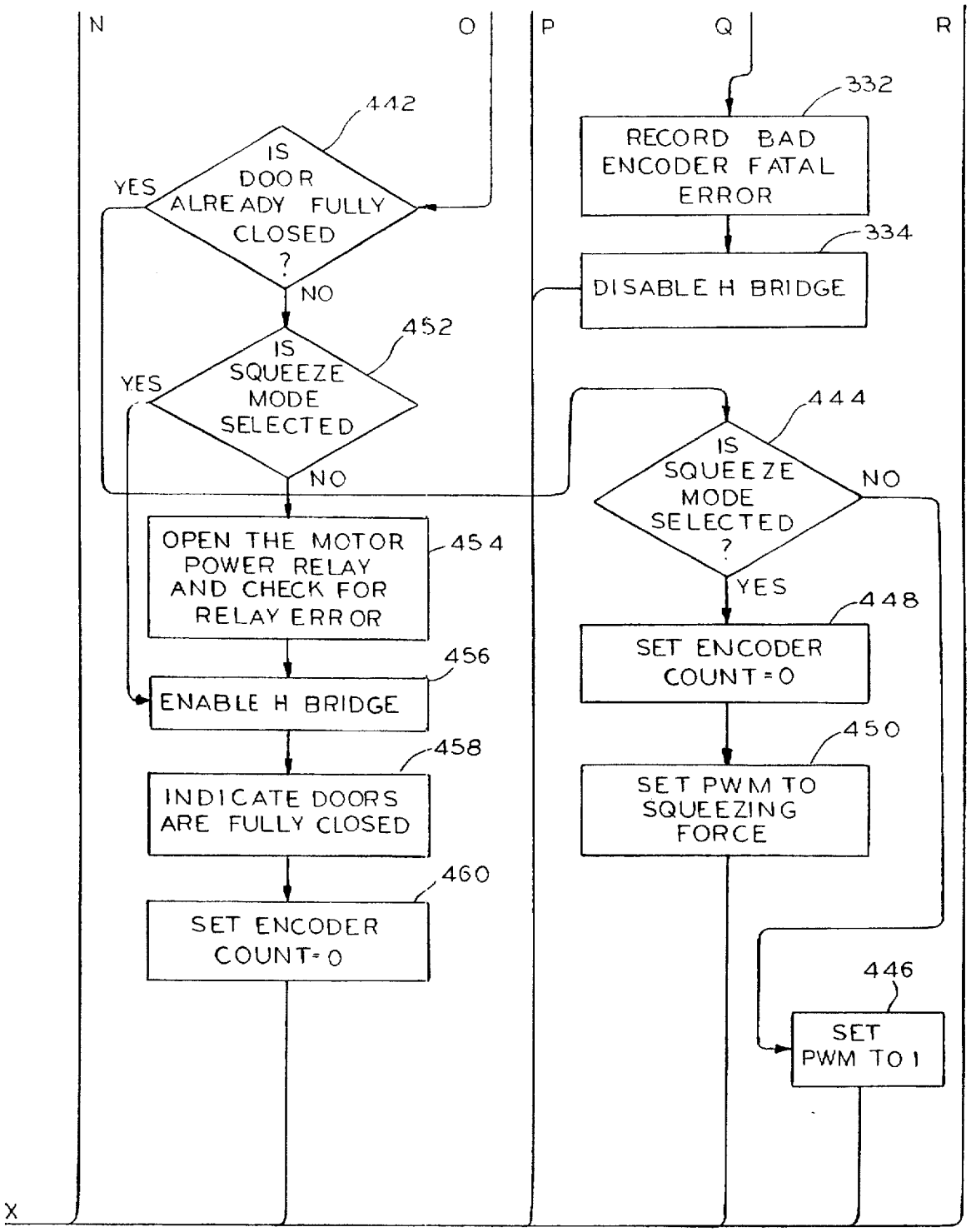

Referring to FIG. 9, a flow diagram illustrates a program for the Check Safety Edge routine implemented at the blocks 214, 220, 224, 228 and 232 of the main loop. The Check Safety Edge routine starts at a start node 240. A decision block 242 determines if the door is opening, completely open, or completely closed. If so, then the routine ends. If not, then the safety edge is read three times at a block 244. A decision block 246 determines if the safety edge is tripped on each read. The safety edge is tripped if there is some object positioned between the doors 16 and 18, as is conventional. If not, then the routine ends. If so, then the control rapidly reduces a PWM output to one at a block 248. Particularly, the DC motor 274 is controlled via the H-bridge circuit 132 using pulse width modulation control. The pulse width represents the average voltage applied to the motor. The PWM value can be set to any value between 1 and 255. Therefore, if the safety edge is engaged, then the doors must be stopped immediately and reversed to open. At a block 250 the door direction is set to open. A requested encoder count, representing desired door position or movement, is set to the full open distance at a block 252. The H-bridge 132 is enabled at a block 254. A power relay, part of the controller 130, see FIG. 7, used to supply power to MOSFETs of the H-bridge 132 is closed at a block 256 and a check is made for relay error. The PWM is increased to a user select minimum opening speed at a block 258. The routine then ends.

Referring to FIGS. 10A–10G, the Seek Position routine is illustrated. This routine is used to move the doors 16 and 18 to a position based on commands received via the Neuron® interface 134. This routine may also speed up or slow down door movement according to the position in the cycle. This routine begins at a start node 300. A decision block 302 determines if there is a request to remove power. If so, then power to the H-bridge is removed at a block 304 and the routine ends. If not, then a decision block 306 determines if the door is fully open or trying to open. If so, then a decision block 308 determines if the door has moved less than thirty counts after fully opening. If so, then the PWM is set equal to one at a block 310. The H-bridge is enabled at a block 312 and the power relay is opened at a block 314. The routine then ends. Otherwise, a decision block 316 determines if the door has opened to within six counts of the fully open position. If so, then the door is indicated as fully open at a block 318 and the motor power is turned off at a block 320. The H-bridge is enabled to apply locking torque to the motor at a block 322. The door direction is set to open at a block 324. A decision block 326 determines if the close switch is engaged before expected. If not, then the routine ends. If so, then a decision block 328 determines if the decoder is faulty. If not, then a block 330 indicates that someone might be playing with the close switch and a retry is allowed. The routine then ends. If the encoder is faulty, then a Bad Encoder Fatal Error is recorded at block 332. The H-bridge is disabled at a block 334 and the routine ends.

Returning to the block 316, if the door is not opened to within six counts of the fully opened position, then the door direction is set to open at a block 336. The H-bridge is enabled at a block 338. A decision block 340 determines if motor power is on. If not, then the motor power relay is closed at a block 342. Thereafter, or if power is already on, then a decision block 344 determines if the door is in the clutch pickup zone. If so, then a decision block 346 determines if the door is in a nudge mode. If so, then the PWM is set to the preselected nudging speed at block 348. The routine then ends. If the door is not in the nudge mode, then a decision block 350 determines if the door has been in the clutch zone for a preselect time. If not, then the routine ends. If so, then the PWM is increased over time to get the door out of the clutch zone at a block 352. The routine then ends.

Returning to the decision block 344, if the door is not in the clutch pickup zone then a decision block 354 determines if the door is in a slow down zone. If so, then a decision block 356 determines if the overcurrent flag is set. If so, the routine ends. If not, a decision block 358 determines if the door is in the nudge mode. If so, the PWM is set to maximum nudging speed at block 360 and the routine ends. If not, the PWM is reduced toward opening minimum speed based on nearness to fully opened position at block 362. The routine then ends.

If the door is not in a slow down zone, as determined at the decision block 354, a decision block 364 determines if the door is in the nudging mode. If so, the PWM is set to maximum nudging speed at block 366. The routine then ends. If the door is not in the nudging mode, then a decision block 368 determines if an overcurrent flag is set. If not, then the PWM is set to the opening maximum speed at the block 370. If so, then the PWM is set to the opening minimum speed at a block 372. In either case, the routine then ends.

Returning to the decision block 306, if the door is not fully open or trying to open, then a decision block 374 determines if the door is closed or trying to close. If not, the routine ends. If so, then a decision block 376 determines if the door has moved less than thirty counts after fully closing. If so, then an indication is made that the door is no longer fully closed at a block 378. The routine then ends. If not, then a decision block 380 determines if the limit switch 120 is engaged. If so, then a decision block 382 determines if the switch 120 just engaged. If so, then an indication is made that the door is fully closed at block 384. The encoder count is reset to zero at block 386. The routine then ends.

Returning to the decision block 380, if the limit switch 120 is not engaged, then a decision block 388 again determines if the close limit switch 120 is engaged or if the door is within six counts of the requested count. If not, then an indication is made that the door is not fully closed at block 390. The door direction is set to close at block 392. The H-bridge is enabled at block 394. A decision block 396 determines if the motor power is disabled. If so, then the motor power relay is closed at block 398. Thereafter, or if the motor power was not disabled, then decision block 400 determines if the door is in the clutch pickup zone and the overcurrent flag is not set. If so, a decision block 402 determines if the door is in the nudging mode. If so, the PWM is set to maximum nudging speed at a block 404. The routine then ends. Otherwise, a decision block 406 determines if the door is in the nudging mode. If so, the PWM is set to the maximum nudging speed at a block 408 and the routine ends. If not, a decision block 410 determines if an overcurrent flag is set. If not, the PWM is set to maximum closing speed at block 412 and the routine ends. If so, the PWM is set to minimum closing speed at block 414 and the routine ends.

Returning to decision block 402, if the door is not in a nudging mode, then the PWM is reduced toward closing minimum speed based on nearness to fully closed position at block 416. A decision block 418 determines if the door is in a clutch pickup zone. If not, the routine ends. If so, power is added to the PWM, based on how long the door has been in the clutch pickup zone, at a block 420. The routine then ends.

Returning to the decision block 382, if the limit switch had not just engaged, then a decision block 422 determines if the encoder count is greater than four hundred, representing approximately 2.2 inches. If not, control advances to the decision block 388, discussed above. If so, a decision block 424 determines if the close limit switch is still engaged after a short delay. If not, then the routine ends. If so, then an indication is made that the close limit switch is engaged before expected at a block 426. The PWM is rapidly reduced to one at block 428. The door direction is set to open at block 430. The door is put in the nudging mode at block 432. The requested encoder count is set to the full open distance at a block 434. The H-bridge is enabled at a block 436. A decision block 438 determines if motor power is on. If so, the routine ends. If not, the motor power relay is closed at block 440 and the routine then ends.

Returning to the decision block 388, if the close switch is engaged or the door is within six counts of the requested count, then a decision block 442 determines if the door is already fully closed. If so, then a decision block 444 determines if the squeeze mode is selected. If not, the PWM is set to one at block 446 and the routine ends. If so, the encoder count is set to zero at block 448. The PWM is set to squeezing force at block 450. The routine then ends. If the door is not already fully closed, as determined at the block 442, then a decision block 452 determines if the squeeze mode is selected. If not, the motor power relay is opened at a block 454. Thereafter, or if the squeeze mode is selected, then the H-bridge is enabled at block 456. An indication is made that the doors are fully closed at block 458. The encoder count is set to zero at block 460. The routine then ends.

Figure 11A:
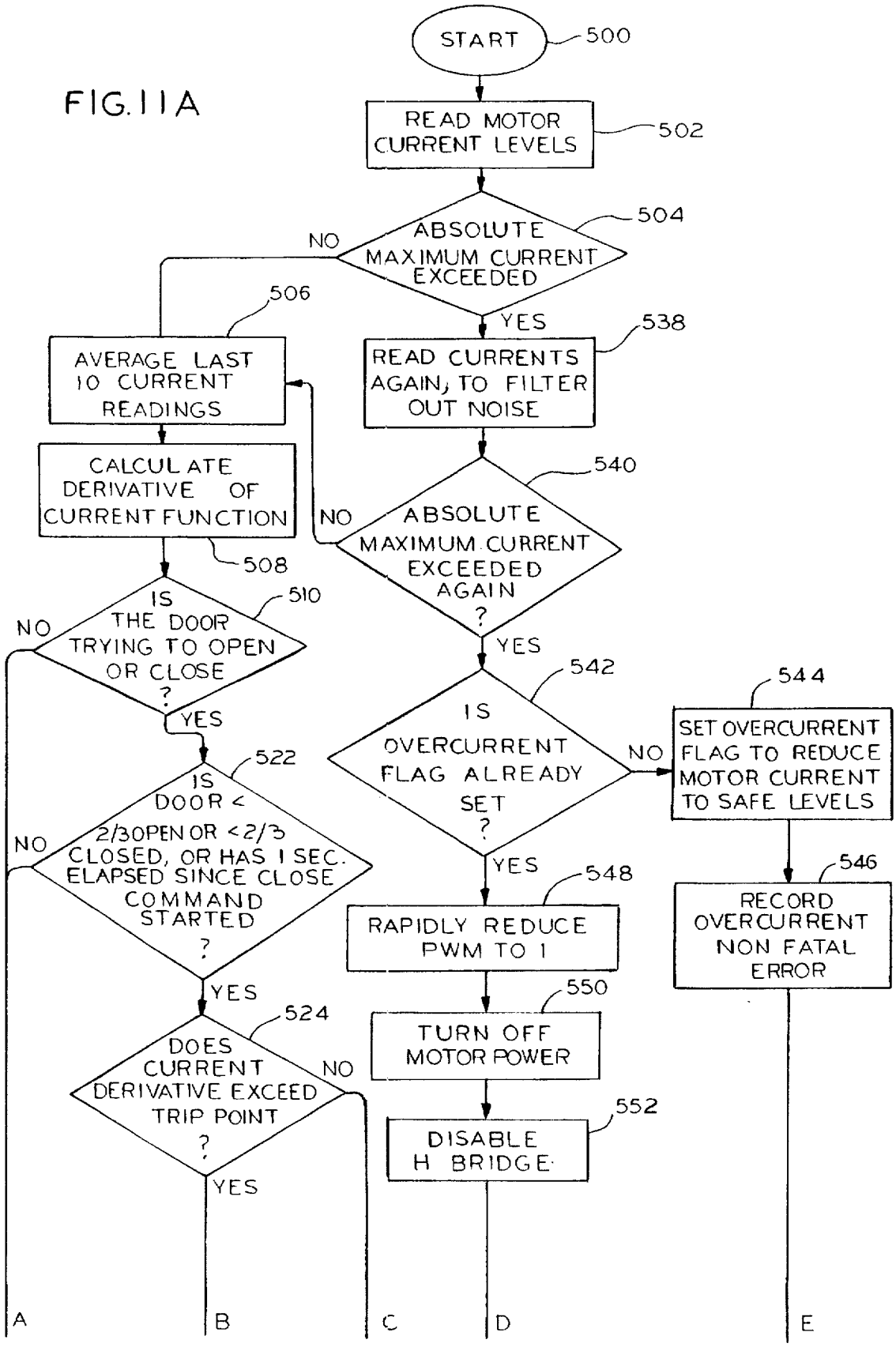
FIGS. 11A and 11B comprise a flow diagram of a Check for Overcurrents routine of the main loop of FIG. 8.
Figure 11B:
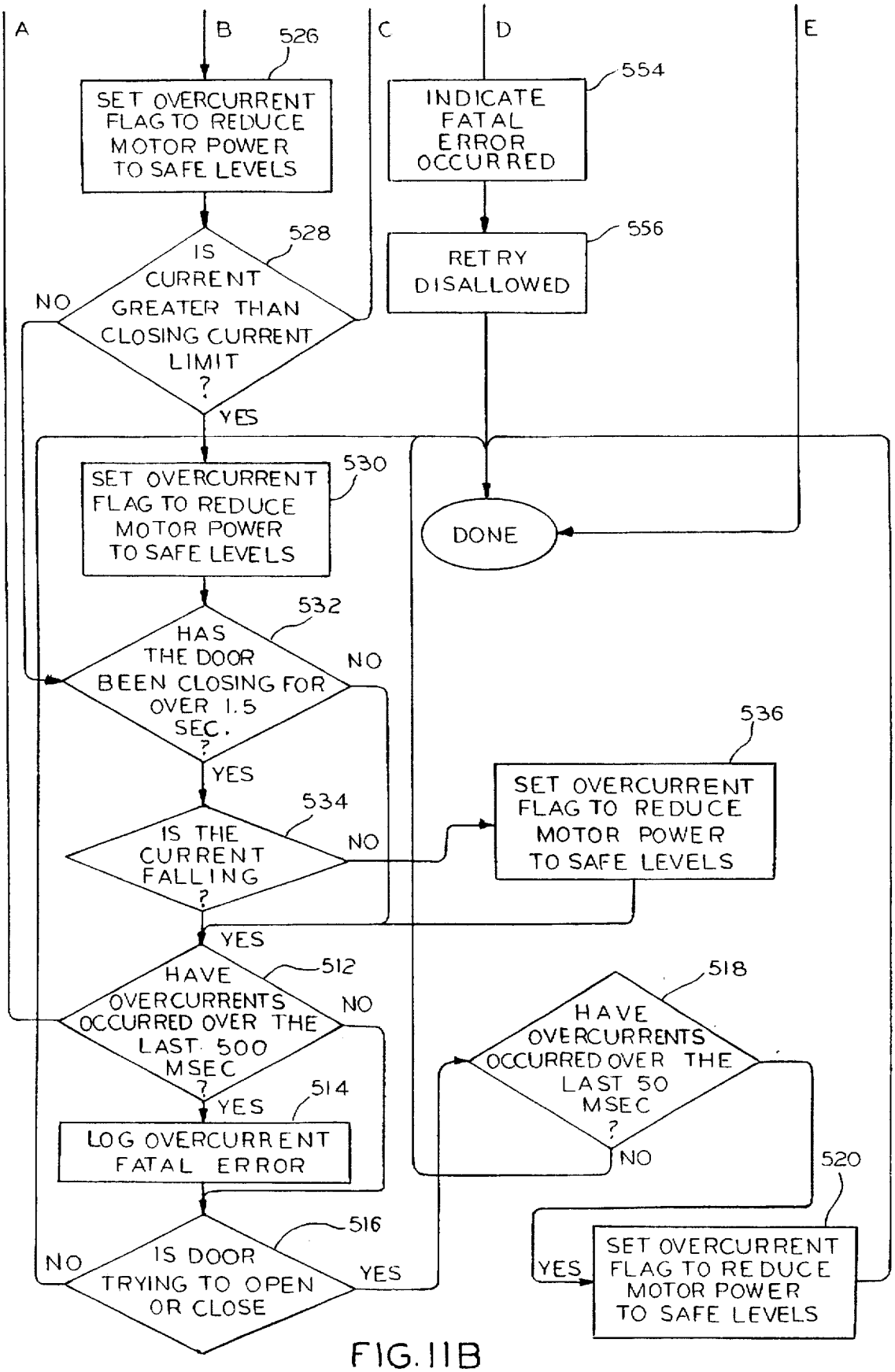

Referring to FIGS. 11A and 11B, a flow diagram illustrates operation of the Check For Overcurrents routine implemented at the block 222 of FIG. 8. This routine begins at a start node 500 and reads motor current levels at a block 502. Particularly, motor current is read based on the analog to digital converters in the H-bridge controller circuit 130. This is compared to an absolute maximum value which is not user changeable. An overcurrent flag can be set which is an indication to the rest of the system that such an event has occurred. Appropriate action is then taken.

After motor current levels are read, a decision block 504 determines if the absolute maximum current is exceeded. If not, then an average of the last ten current readings is calculated at a block 506. A derivative is calculated at a block 508. This is used to determine if an obstruction exists based on current increasing rapidly. A decision block 510 determines if the door is trying to open or close. If not, a decision block 512 determines if overcurrent has occurred over the last five hundred milliseconds. If so, then an overcurrent fatal error is logged at a block 514. Thereafter, or if no overcurrents have occurred in the last five hundred milliseconds, then a decision block 516 determines if the door is trying to open or close. If not, the routine ends. If so, a decision block 518 determines if overcurrents have occurred over the last fifty milliseconds. If not, the routine ends. If so, the overcurrent flag is set to reduce motor power to safe levels at a block 520. The routine then ends.

Returning to the decision block 510, if the door is trying to open or close, then a decision block 522 determines if the door is less than two-thirds open or less than two-thirds closed, or one second has elapsed since close commands started. If not, control advances to the block 512, discussed above. If so, then a decision block 524 determines if the current derivative exceeds a pre-select trip point. If so, the overcurrent flag to reduce motor power to safe levels is set at block 526. Thereafter, or if the current derivative did not exceed the trip point, then a decision block 528 determines if current is greater than the closing current limit. If so, the overcurrent flag to reduce motor power to safe levels is set at block 530. Thereafter, or if the current was not greater than the closing current limit, then a decision block 532 determines if the door has been closing for more than 1.5 seconds. If not, then control proceeds to the block 512, discussed above. If so, a decision block 534 determines if the current is falling. If so, control proceeds to the block 512. If not, the overcurrent flag to reduce motor power to safe levels is set at block 536. Control then proceeds to the block 512, discussed above.

Returning to the decision block 504, if absolute motor current is exceeded, then currents are read again at a block 538. This is done to ensure that the reading is not based on noise. A decision block 540 determines if the absolute maximum current is again exceeded. If not, then control proceeds to the block 506, discussed above. If so, then decision block 542 determines if the overcurrent flag is already set. If not, the overcurrent flag to reduce motor current to safe levels is set at block 544. The Overcurrent Non Fatal Error is recorded at block 546. The routine then ends. If the overcurrent flag is already set, then the PWM is rapidly reduced to one at block 548. The motor power is turned off at block 550. The H-bridge is disabled at block 552. An indication is made that a fatal error has occurred at block 554. A Retry Disallowed flag is set at a block 556. The routine then ends.

Figure 12A:
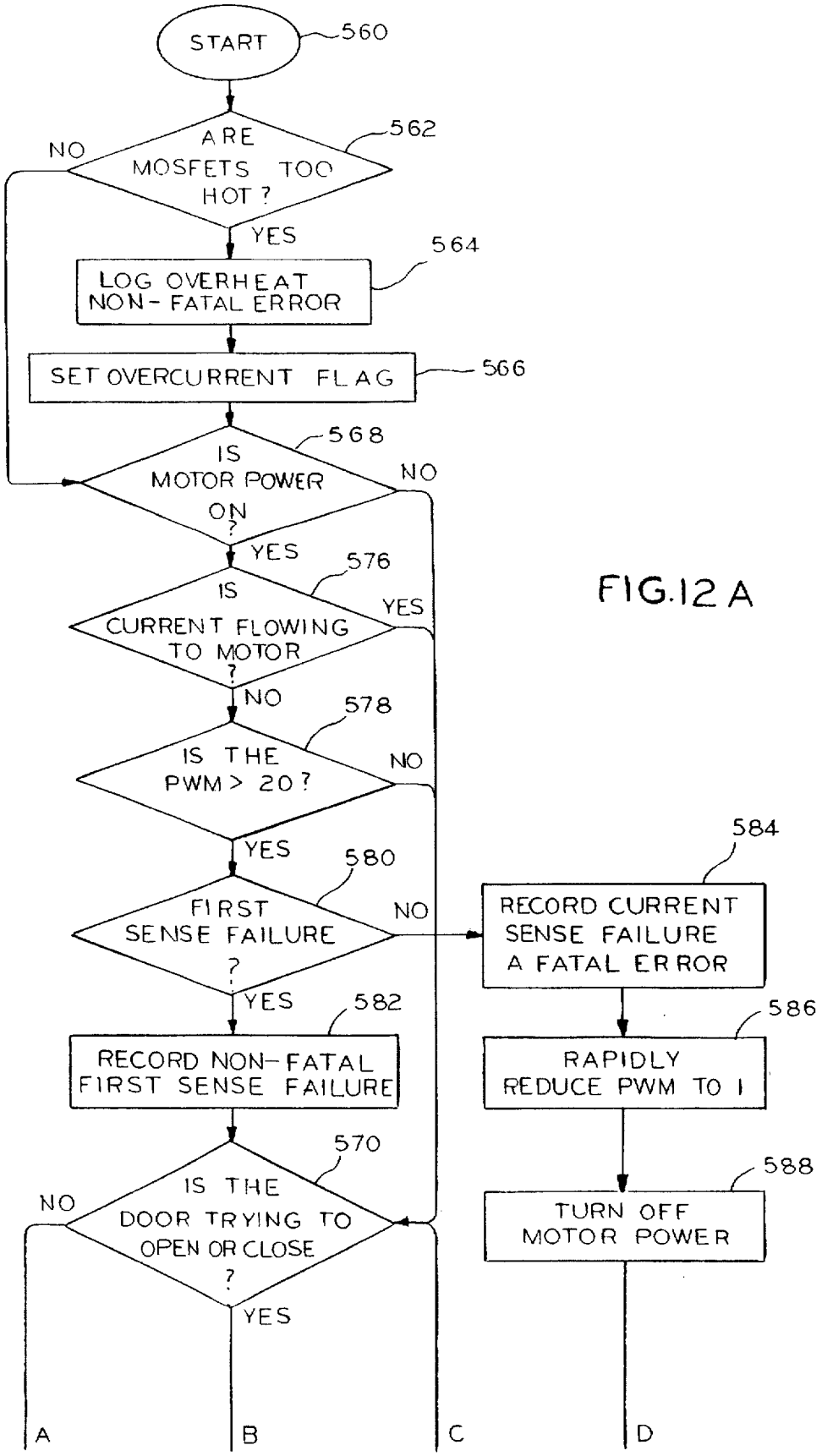
FIGS. 12A–12C comprise a flow diagram of a Check for Error Conditions routine of the main loop of FIG. 8.
Figure 12B:
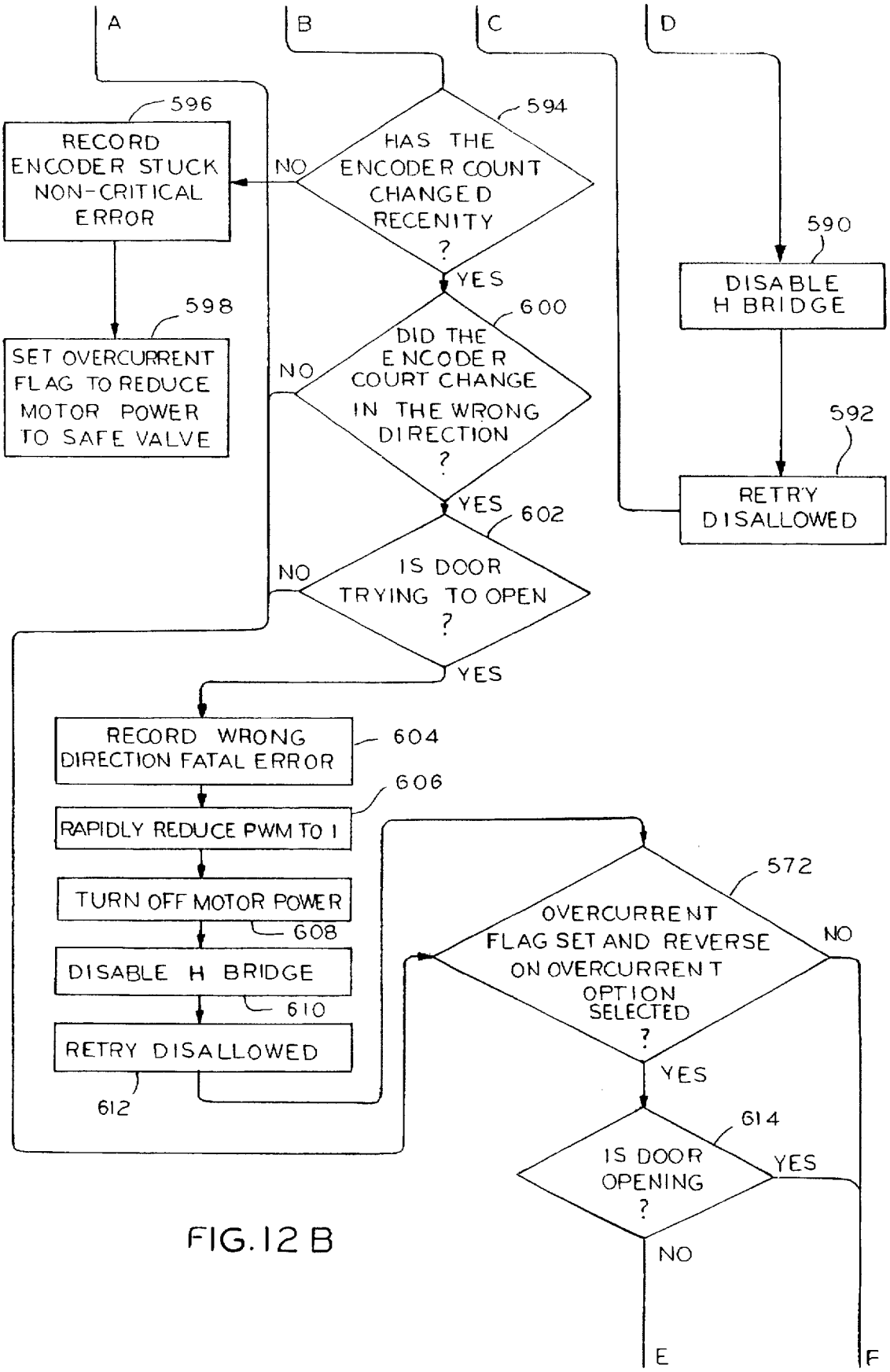
Figure 12C:
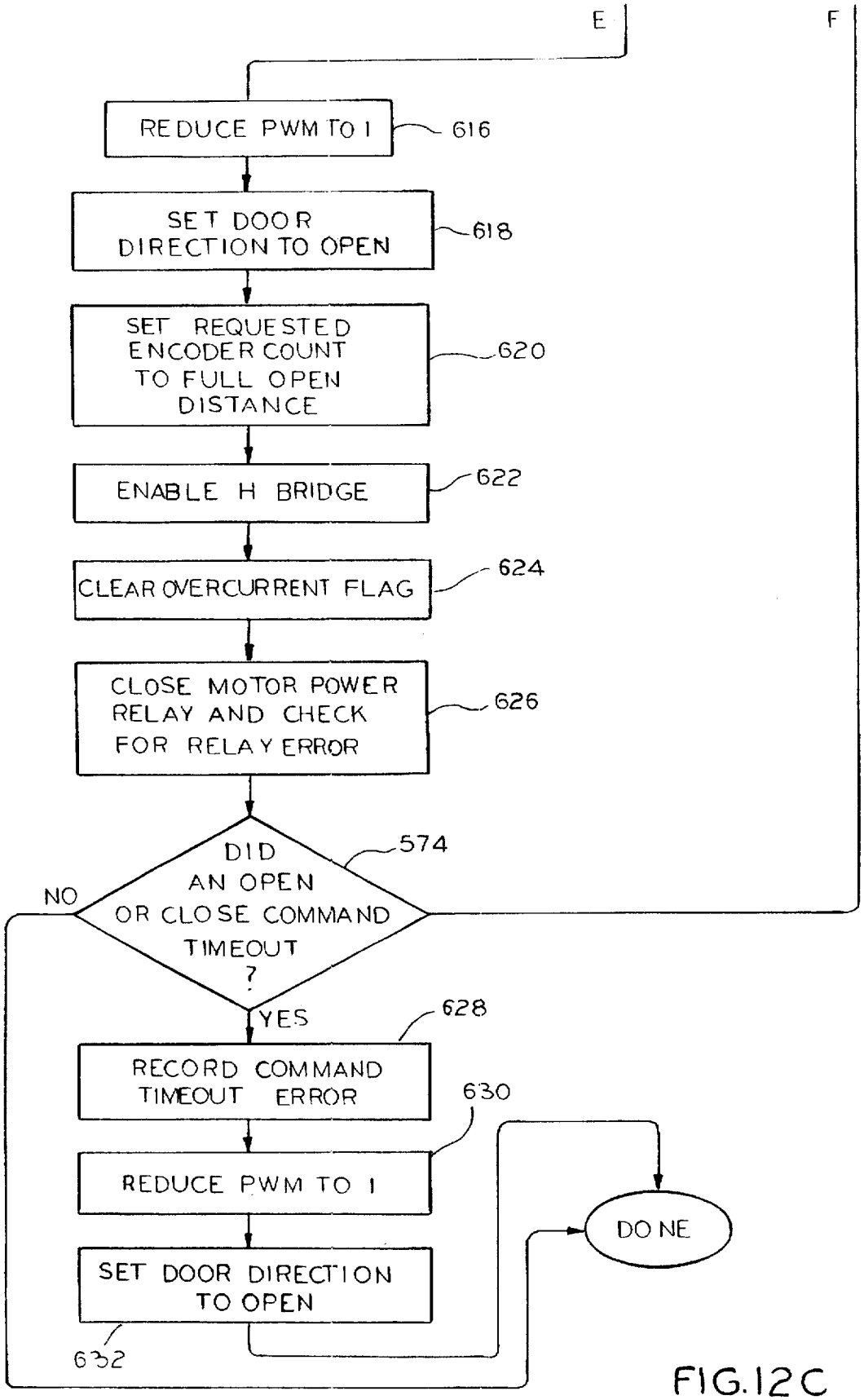

Referring to FIGS. 12A–12C, a flow diagram illustrates operation of a Check For Error Conditions routine implemented at the block 226 of FIG. 8. This routine is used mostly while the doors are closing and provides failure mode analysis. It addresses possible failures and takes corrective action. The loop begins at a start node 560. A decision block 562 determines if the MOSFETs are too hot based on temperature feedback. If so, then an Overheat Non Fatal Error is logged at block 564 and the overcurrent flag is set at block 566. Thereafter, or if the MOSFETs were not too hot, then a decision block 568 determines if motor power is on. If not, then a decision block 570 determines if the door is trying to open or close. If not, a decision block 572 determines if the overcurrent flag is set and Reverse On Overcurrent option has been selected. If not, then a decision block 574 determines if an open or closed command timeout has been reached. If not, then the routine ends. These determinations, performed serially, comprise the failure mode analysis discussed above.

Returning to the decision block 568, if motor power is on, then a decision block 576 determines if current is flowing to the motor. If so, control proceeds to the block 570, discussed above. If not, a decision block 578 determines if the PWM is greater than twenty. If not, control proceeds to the block 570. If so, a decision block 580 determines if this is the first sensed failure. If so, then a Non-Fatal First Sensed Failure is recorded at block 582. Control then proceeds to the block 570. If it is not a first sensed failure, then a current sensed failure is recorded as a Fatal Error at block 584. The PWM is rapidly reduced to one at block 586. Motor power is turned off at block 588. The H-bridge is disabled at block 590. The Retry Disallowed flag is set at block 592. Control the proceeds to the block 570.

If the door is trying to open or close, as determined at the block 570, then a decision block 594 determines if the encoder count has changed recently. If not, then an Encoder Stuck Non-Critical Error is recorded at block 596. An overcurrent flag to reduce the motor power to safe value is set at block 598. Control then proceeds to the block 572. If the encoder count has changed recently, then a decision block 600 determines if the encoder count changed in the wrong direction. If not, control advances to the block 572. If so, a decision block 602 determines if the door is trying to open. If not, control advances to block 572. If so, a Wrong Direction Fatal Error is recorded at block 604. The PWM is reduced to one at block 606. Motor power is turned off at block 608. The H-bridge is disabled at block 610. The Retry Disallowed flag is set at block 612. Control then advances to the next test at the block 572.

If the overcurrent flag is set and the Reverse On Overcurrent option is selected, then a decision block 614 determines if the door is opening. If so, control advances to the decision block 574. If not, the PWM is reduced to one at a block 616. The door direction is set to open at a block 618. The requested encoder count is set to full open distance at a block 620. The H-bridge is enabled at a block 622. The overcurrent flag is cleared at a block 624. The motor power relay is closed at a block 626. The control then proceeds to the final test.

If an open or closed command timeout has occurred at the decision block 574, then the Command Timeout Error is recorded at a block 628. The PWM is reduced to one at block 630. The door direction is set to open at block 632. The routine then ends.

Figure 13A:
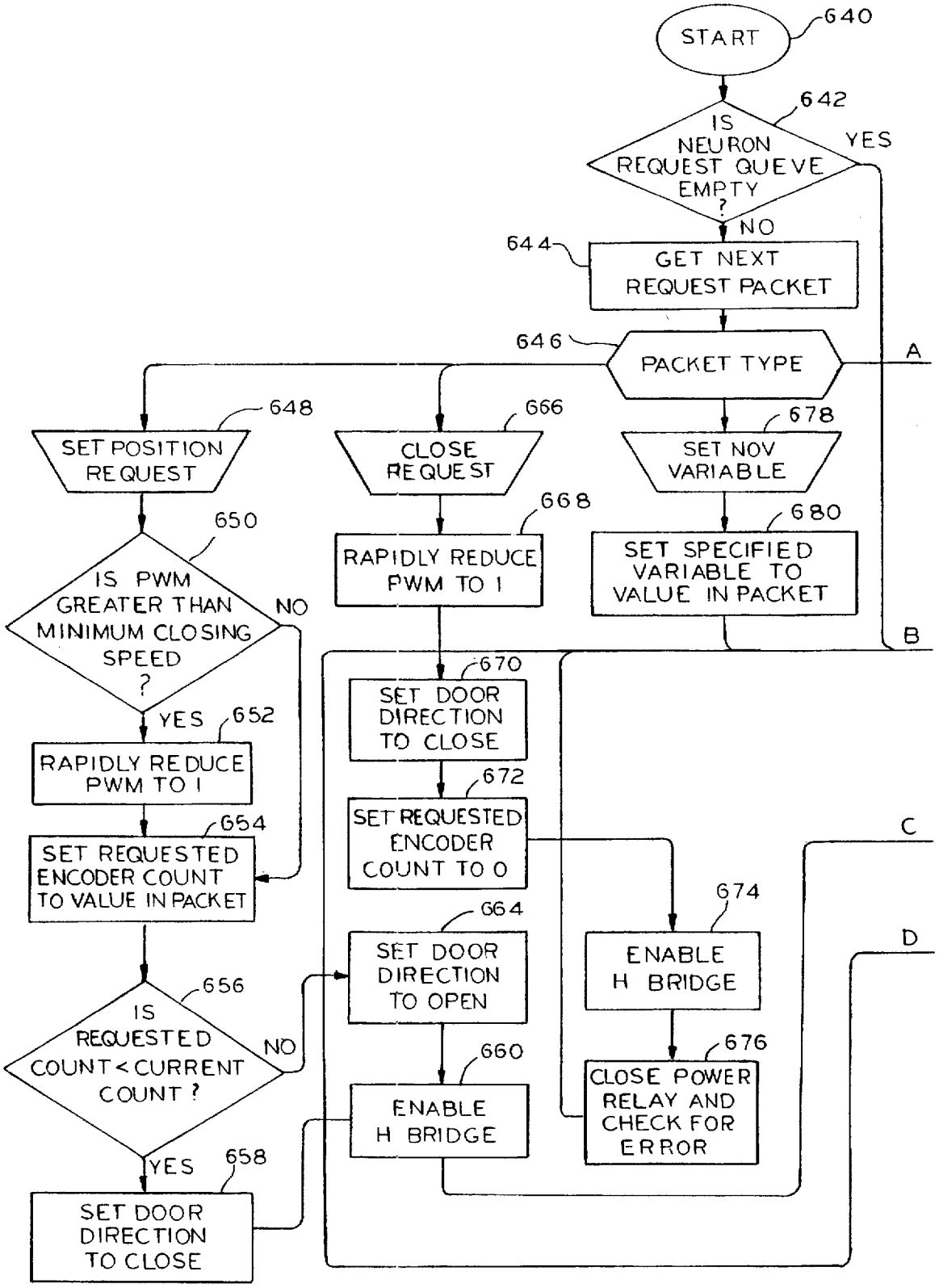
FIGS. 13A–13B comprise a flow diagram of a Process Neuron Request routine of the main loop of FIG. 8.
Figure 13B:
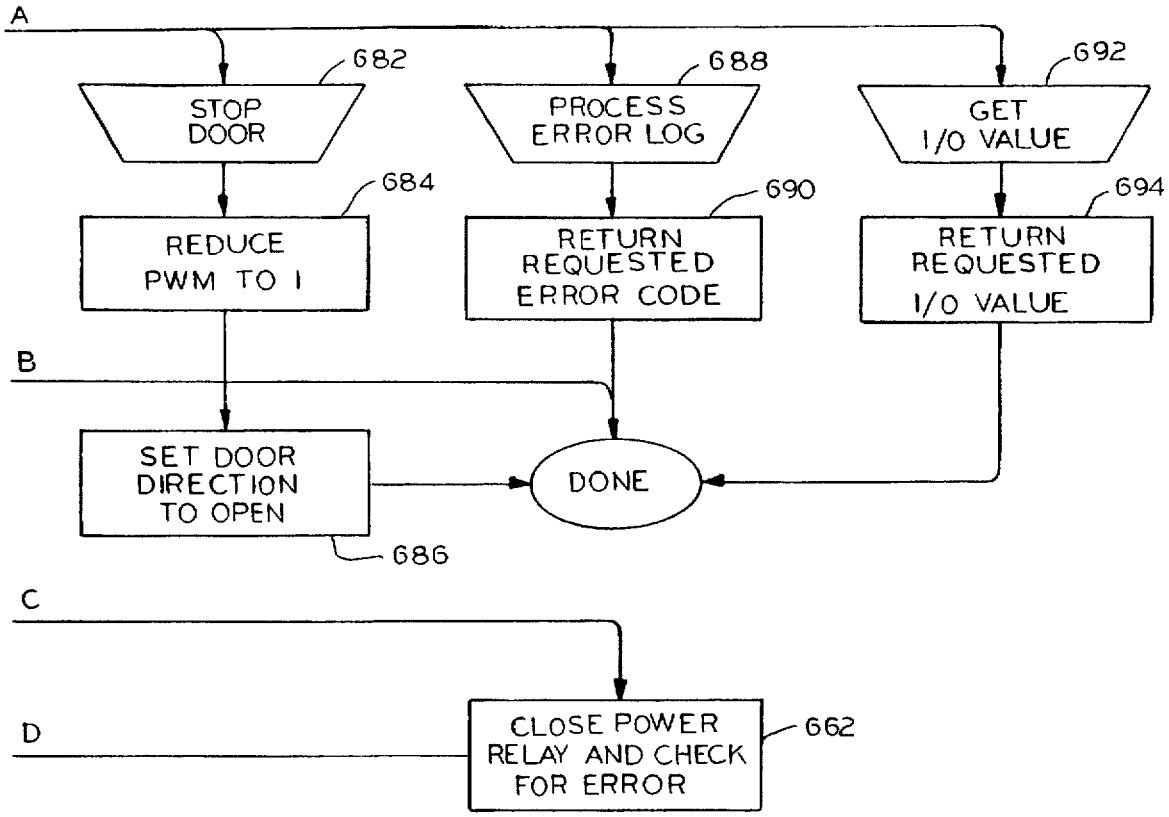

Referring finally to FIGS. 13A–13B, a flow diagram illustrates operation of the Process Neuron® Request routine implemented at the block 212 of FIG. 8. This routine is used to pass messages between the network and the microprocessor 124. The network messages may be operating commands from a car controller or programming commands from a programming device.

This routine begins at start node 640. A decision block 642 determines if the Neuron® Request queue is empty. If so, the routine ends. If not, then the program gets the next Neuron® Request packet at a block 644. The packet type is then determined at a block 646. Depending on the packet type the control will implement a specific sequence. If the packet type is for a set position request at block 648, then a decision block 650 determines if the PWM is greater than minimum closing speed. If so, the PWM is rapidly reduced to one at block 652. Thereafter, or if the PWM is not greater than the minimum closing speed, then the requested encoder count is set to the value in the packet at block 654. A decision block 656 determines if the requested count is less than the current count. If so, the door direction is set to close at block 658. The H-bridge is enabled at block 660. The power relay is closed at block 662. The routine then ends. If the requested count is not less than the current count, then the door direction is set to open at block 664. Control then proceeds to the block 660.

If the packet was a close request, at block 666, then the PWM is rapidly reduced to one at block 668. The door direction is set to close at block 670. The requested encoder count is set to zero at block 672. The H-bridge is enabled at block 674. The power relay is closed at block 676. The routine then ends.

If the packet type was to set an NOV variable at block 678, then the specified variable is set to the value in the packet at block 680 and the routine then ends. The NOV variables are non-volatile user select variables such as, for example, open minimum speed, open maximum speed, close minimum speed, close maximum speed, nudging speed, or the like. These values are selected by an adjuster using a programming tool or service tool connected on the network.

If the packet type was to stop the door at block 682, then the PWM value is reduced to one at block 684. The door direction is set to open at block 686. The routine then ends.

If the packet type was to process an error log at block 688, then the requested error code is returned to the network at block 690. The routine then ends.

If the packet type was to get an I/O value at block 692, then the requested I/O value is returned to the network at a block 694. The routine then ends.

As described, the main loop continually implements each of the described routines to maintain desired positioning of the door or doors. The setting of parameters, such as door opening speeds and the like, are done by loading the NOV variables.

In accordance with the invention, the linear door drive and door operator are provided with fewer parts, resulting in a lighter weight construction. The use of a worm gear provides a mechanical advantage and results in a low profile design at the front end the car. The time required to install and adjust the operator is a fraction of the time required to install and adjust prior door operators. This is due to the drop-in construction of the door operator relative to the linear drive which is fixedly attached to the header.

I claim:

1. In an elevator system having a car provided with a doorway and a door movable across said doorway, an improved mechanism to move said door selectively to open and closed positions comprising:

a header mounted to the car above the doorway, the header supporting a linear drive carrying the door, the drive including a spool means rotationally mounted to the header for driving a cable wound about the spool means, the cable being operatively connected to a hanger carrying the door for moving the hanger linearly across the header responsive to rotational movement of the spool means, the spool means further including a vertically extending axial opening;

a door operator comprising a motor, the motor driving an output shaft;

means for securing the door operator to the header so that the output shaft is received in the spool means axial opening, whereby operation of the motor causes rotation of the spool means.

2. The improved mechanism of claim 1 wherein said output shaft comprises a Morse taper shaft.

3. The improved mechanism of claim 1 wherein said motor has a motor shaft and said operator further comprises a worm gear having an input shaft and said output shaft is part of the worm gear, and means for coupling the motor shaft to the input shaft.

4. The improved mechanism of claim 3 wherein said operator further comprises a bracket supporting the motor and the worm gear with the motor shaft extending horizontally and the output shaft extending vertically downwardly.

5. The improved mechanism of claim 4 wherein the securing means comprises a fastener securing the bracket to the header.

6. The improved mechanism of claim 4 wherein the securing means comprises a nut threaded to the output shaft for securing the output shaft to the spool means.

7. The improved mechanism of claim 4 further comprising means for resiliently mounting the motor to the bracket.

8. The improved mechanism of claim 7 wherein the mounting means comprises rubber washers.

9. The improved mechanism of claim 1 wherein the spool means comprises a spool having circumferential grooves carrying the cable, received between blocks mounting the spool to the header.

10. The improved mechanism of claim 1 further comprising an auto tensioner mounted to the header opposite the spool means for maintaining tension on the cable.

11. In an elevator system having a car provided with a doorway and a pair of doors movable across said doorway, an improved mechanism to move said doors selectively to open and closed positions comprising:

a header mounted to the car above the doorway, the header supporting a linear drive carrying the doors, the drive including a spool means rotationally mounted to the header for driving a cable wound about the spool means, the cable being operatively connected to a pair of hangers carrying the respective doors for moving the hangers linearly across the header responsive to rotational movement of the spool means, the spool means further including a vertically extending axial opening;

a door operator comprising a motor, the motor driving an output shaft;

means for securing the door operator to the header so that the output shaft is received in the spool means axial opening, whereby operation of the motor causes rotation of the spool means.

12. The improved mechanism of claim 11 wherein said output shaft comprises a Morse taper shaft.

13. The improved mechanism of claim 11 wherein said motor has a motor shaft and said operator further comprises a worm gear having an input shaft and said output shaft is part of the worm gear, and means for coupling the motor shaft to the input shaft.

14. The improved mechanism of claim 13 wherein said operator further comprises a bracket supporting the motor and the worm gear with the motor shaft extending horizontally and the output shaft extending vertically downwardly.

15. The improved mechanism of claim 14 wherein the securing means comprises a fastener securing the bracket to the header.

16. The improved mechanism of claim 14 wherein the securing means comprises a nut threaded to the output shaft for securing the output shaft to the spool means.

17. The improved mechanism of claim 14 further comprising means for resiliently mounting the motor to the bracket.

18. The improved mechanism of claim 17 wherein the mounting means comprises rubber washers.

19. The improved mechanism of claim 11 wherein the spool means comprises a spool having circumferential grooves carrying the cable, received between blocks mounting the spool to the header.

20. The improved mechanism of claim 11 further comprising an auto tensioner mounted to the header opposite the spool means for maintaining tension on the cable.

* * * * *